US006093879A

United States Patent [19]

Pye

[11] Patent Number: 6,093,879

[45] Date of Patent: Jul. 25, 2000

[54] BICAMERAL SCALE MUSICAL INSTRUMENTS

[76] Inventor: T. Wilfred Pye, 304 Fairmont Dr., Houma, La. 70360

[21] Appl. No.: 09/232,588

[22] Filed: Jan. 19, 1999

[51] Int. Cl.[7] ..... G10C 3/12

[52] U.S. Cl. ..... 84/451; 84/380 R; 84/387 R; 84/312 R; 84/314 R

[58] Field of Search ..... 84/645, 451, 314 R, 84/312 R, 377, 380 R, 387 R

[56] References Cited

U.S. PATENT DOCUMENTS

| | | | |
|---|---|---|---|
| 4,031,800 | 6/1977 | Thompson | 84/423 R |
| 4,132,143 | 1/1979 | Stone | 84/314 R |
| 5,129,303 | 7/1992 | Coles | 84/451 X |
| 5,404,788 | 4/1995 | Frix | 84/423 R |

*Primary Examiner*—Jeffrey Donels

[57] ABSTRACT

This application relates to various stepped pitch instruments crafted to a novel musical tuning system for the generated frequencies. As such, the tone selection devices are arranged to a distinct set of interval specifications when compared to the tone selection devices for a prior art instrument crafted to sound the common frequencies of 12 tone equal temperament. To generate the bicameral tones, the preferred tuning system utilizes two different series of Pythagorean perfect fifths separated by a known reference interval. Relative to 12 tone, the instant tuning system is primarily concerned both with improving the sour major and minor thirds and perfecting the slightly flat fifths. Substantially fewer tones per octave are used than the number required by standard just intonation. Various modifications to existing prior art instruments are described, as well as a novel enharmonic multitone keyboard.

20 Claims, 16 Drawing Sheets

| | | | | | | |
|---|---|---|---|---|---|---|
| E<br>4 -792 | A#<br>10 -192 | E<br>4 408 | A#<br>10 1008 | E<br>4 1608 | A#<br>10 2208 | E<br>4 2808 |
| D#<br>3 -894 | A<br>9 -294 | D#<br>3 306 | A<br>9 906 | D#<br>3 1506 | A<br>9 2106 | D#<br>3 2706 |
| D<br>2 -996 | G#<br>8 -396 | D<br>2 204 | G#<br>8 804 | D<br>2 1404 | G#<br>8 2004 | D<br>2 2604 |
| C#<br>1 -1098 | G<br>7 -498 | C#<br>1 102 | G<br>7 702 | C#<br>1 1302 | G<br>7 1902 | C#<br>1 2502 |
| C<br>12 -1200 | F#<br>6 -600 | C<br>12 0 | F#<br>6 600 | C<br>12 1200 | F#<br>6 1800 | C<br>12 2400 |
| B<br>11 -1302 | F<br>5 -702 | B<br>11 -102 | F<br>5 498 | B<br>11 1098 | F<br>5 1698 | B<br>11 2298 |
| A#<br>10 -1404 | E<br>4 -804 | A#<br>10 -204 | E<br>4 396 | A#<br>10 996 | E<br>4 1596 | A#<br>10 2196 |
| A<br>9 -1506 | D#<br>3 -906 | A<br>9 -306 | D#<br>3 294 | A<br>9 894 | D#<br>3 1494 | A<br>9 2094 |
| G#<br>8 -1608 | D<br>2 -1008 | G#<br>8 -408 | D<br>2 192 | G#<br>8 792 | D<br>2 1392 | G#<br>8 1992 |

Fig. 2

| | | | | | | |
|---|---|---|---|---|---|---|
| 4 | 10 | 4 | 10 | 4 | 10 | 4 |
| 3 | 9 | 3 | 9 | 3 | 9 | 3 |
| 2 | 8 | 2 | 8 | 2 | 8 | 2 |
| 1 | 7 | 1 | 7 | 1 | 7 | 1 |
| 0 | 6 | 0 | 6 | 0 | 6 | 0 |
| 11 | 5 | 11 | 5 | 11 | 5 | 11 |
| 10 | 4 | 10 | 4 | 10 | 4 | 10 |
| 9 | 3 | 9 | 3 | 9 | 3 | 9 |
| 8 | 2 | 8 | 2 | 8 | 2 | 8 |

Fig. 4

| | | | | | | |
|---|---|---|---|---|---|---|
| 4 | 10 | 4 | 10 | 4 | 10 | 4 |
| 3 | 9 | 3 | 9 | 3 | 9 | 3 |
| 2 | 8 | 2 | 8 | 2 | 8 | 2 |
| 1 | 7 | 1 | 7 | 1 | 7 | 1 |
| 0 | 6 | 0 | 6 | 0 | 6 | 0 |
| 11 | 5 | 11 | 5 | 11 | 5 | 11 |
| 10 | 4 | 10 | 4 | 10 | 4 | 10 |
| 9 | 3 | 9 | 3 | 9 | 3 | 9 |
| 8 | 2 | 8 | 2 | 8 | 2 | 8 |

Fig. 5

| submerged flat value | lifted sharp value | DEGREE | DEGREE | submerged flat value | lifted sharp value |
|---|---|---|---|---|---|
| 1188 | 0 | (1ST) | ( 7TH) | 588 | 600 |
| 90 | 102 | ( 2ND) | ( 8TH) | 690 | 702 |
| 792 | 804 | ( 9TH) | ( 3RD) | 192 | 204 |
| 294 | 306 | ( 4TH) | (10TH) | 894 | 906 |
| 996 | 1008 | (11TH) | ( 5TH) | 396 | 408 |
| 498 | 510 | ( 6TH) | (12TH) | 1098 | 1110 |

| lifted flat value | submerged sharp value | DEGREE | DEGREE | lifted flat value | submerged sharp value |
|---|---|---|---|---|---|
| 1188 | 0 | (1ST) | ( 7TH) | 588 | 600 |
| 90 | 102 | ( 2ND) | ( 8TH) | 690 | 702 |
| 792 | 804 | ( 9TH) | ( 3RD) | 192 | 204 |
| 294 | 306 | ( 4TH) | (10TH) | 894 | 906 |
| 996 | 1008 | (11TH) | ( 5TH) | 396 | 408 |
| 498 | 510 | ( 6TH) | (12TH) | 1098 | 1110 |

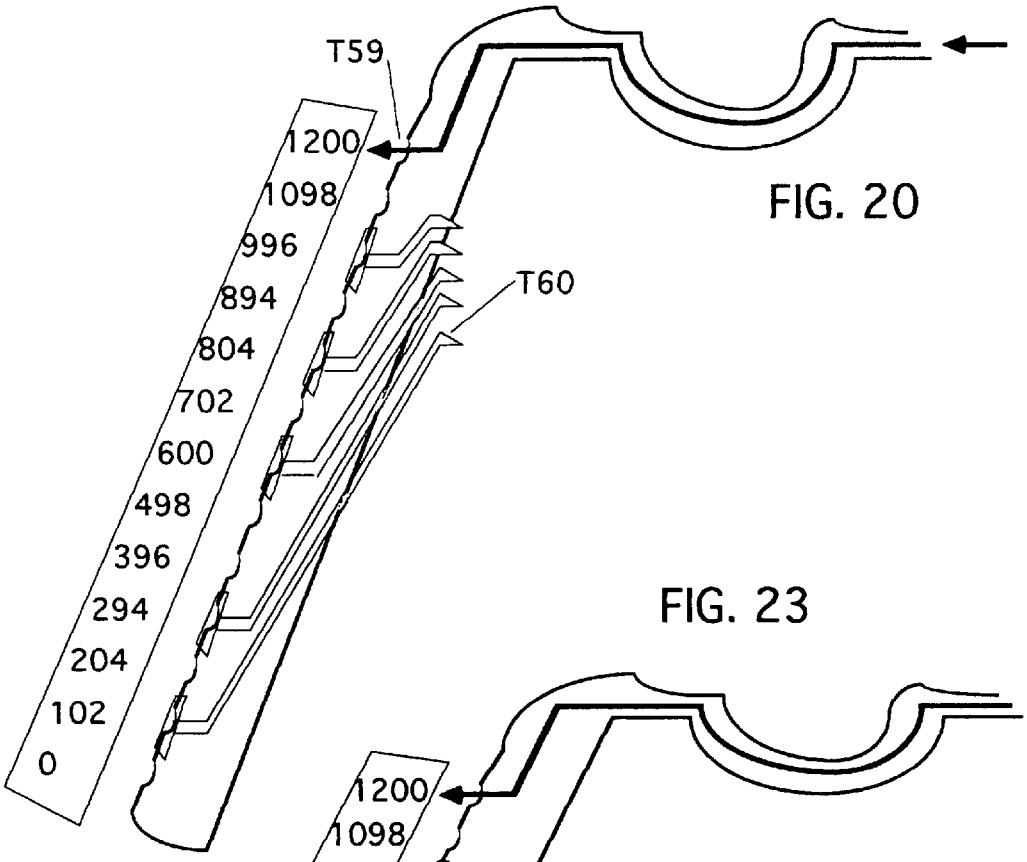
FIG. 20
FIG. 23
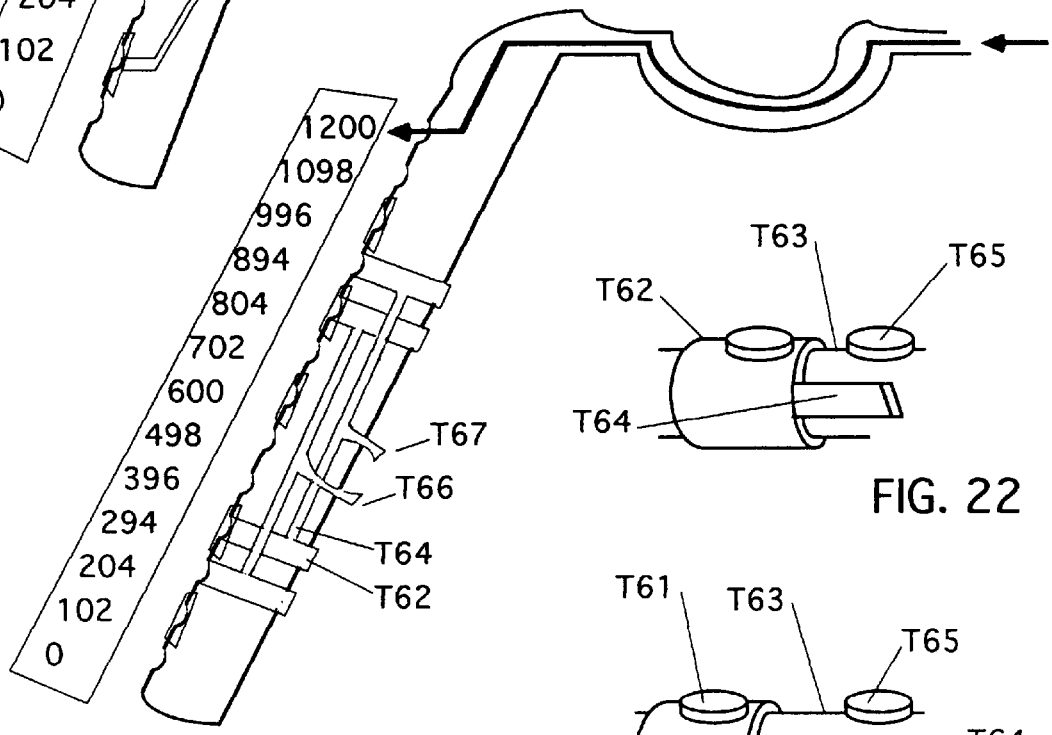
FIG. 22
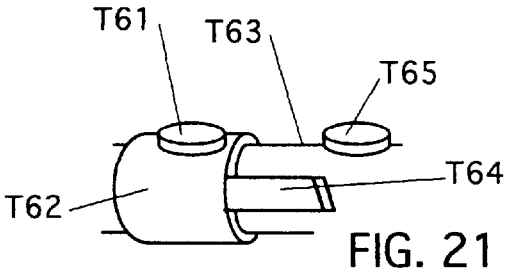
FIG. 21

BICAMERAL SCALE MUSICAL INSTRUMENTS

This application relates to the field of music, and more specifically to various stepped pitch instruments crafted to a particular musical tuning system for the tones. To generate the tones, the preferred tuning system utilizes two different series of Pythagorean perfect fifths separated by a known reference interval. The performer generally utilizes one of the six basic modal chromatic scales fashioned from the unified set of tones derived collectively from the two series of perfect fifths.

Various modifications will be described for existing prior art fixed pitch instruments such as harmonicas, horns, and fretted instruments to empower them to provide the described pitches. A novel keyboard will also be presented. Because keyboards are polyphonic, they have the ability (when configured enharmonicaly) to convey more than a typical 12 member scale of notes. When the pitches are symmetrically configured, keyboards can also allow fingering positions that are physically unvarying with modulations.

DISCUSSION OF THE PRIOR ART

Over 200 years ago the utilization of the 12 tone equal temperament system (termed 12 tone herein) began the slow choking out of the various well temperaments. By the mid 1800's, the process was effectively complete. The longest unequal holdout was known as the meantone temperament. It was last used widely on organs.

Due to the predominance of the acoustical piano, with its standardized Cristofori keyboard, most tuning schemes centered on a method of deciding on the pitch identities of the 12 available tones per octave. These were predominantly the aforementioned well temperaments, which generally featured improved thirds and flat fifths. They played "well" in several musical keys, and somewhat less than well in other key signatures.

It was the decent fifth of 12 tone, and the ability to play equally in all key signatures that gave it momentum. However, the fifth of 12 tone itself is slightly flat by almost 2 cents from theory, and much effort is expended to bring a stringed instrument into conformity with the strictures of the imperfect 700 cent fifth. Tuning a 12 tone instrument is really the art of de-tuning it, as the ear is constantly driven by natural tendencies to tune to the audible, and perfect, 702 cent Pythagorean fifth diatonic interval.

Many other equal temperament systems providing up to over a hundred tones per octave have been explored. Recognized to be the most effective alternatives to the 12 tone system were the 19, 31, 34, 53, 65, and 118 equal temperament divisions. All equal temperament systems are cyclic.

Just intonation is based on the use of pure musical intervals closely corresponding to certain members of the overtone series of harmonics. There is no standard system, but just intonation generally requires a full scale of tones (per octave) numbering close to seventy. To this day, when just intonation is within reach of many musical explorers through the use of computers, the predominance of 12 tone has held steady. Just intonation has been dually charged with a complexity beyond belief to master and with a banal auditory perfection lacking the perceived distinctive dissonance generated by the 5 accidentals of the 12 tone chromatic scale.

But much discontent with the sour diatonic thirds (both major and minor) of 12 tone has endured to this day.

Illustrative of this desire for better thirds is the detailed tuning system of James Heffernan which was awarded U.S. Pat. No. 904,325 on Nov. 17, 1908. Although it was an equal temperament division of an interval into 24 similar steps, the interval chosen to be divided was the diatonic 12th (cent value 1902). The end result was a tuning system with many approximate just intonation interval thirds present, but totally lacking pure repeating octaves. Any musical works to be played with this system would have to have been new, because every past European composer had depended heavily on pure octaves. Heffernan claimed his instruments as keyboards, and did not even attempt to describe systems that would allow traditionally chromatic instruments to sound this unique pitch collection.

OBJECTS AND ADVANTAGES

For stepped pitch musical instruments configured to play same:

It is therefore accordingly an object of the present invention to provide a musical tuning system that will improve on the major and minor triads of 12 tone equal temperament more in the direction of natural acoustical laws.

It is also accordingly an object of the present invention to provide a musical tuning system that will not altogether lose the perceived musical dissonance generated by the accidentals of 12 tone equal temperament.

It is also an object of the present invention to provide a tuning system that will not overwhelm the performer with the modulation complexities of just intonation, by in effect mimicking the chromatic scale of 12 tone.

It is also an object of the present invention to provide a musical tuning system that will be retroactively useful for the musical body of work established for 12 tone equal temperament over the last several centuries, in such a manner that the musical intent of the composer is not lost and the appreciation of an audience is increased.

It is also an object of the present invention to provide a musical tuning system that depends on Pythagorean perfect fifths, allowing a tuner much more accuracy and speed than a system tuned by 700 cent flatted fifths.

It is also an object of the present invention to provide a musical tuning system that will, with certain modifications to the instrument, adapt itself to the prior art instruments of individuals as well as orchestras.

It is also an object of the present invention to provide a system to preserve the common fingerings of fretted instruments, and to expand the usefulness of non-multitone instruments in general, by having certain pitches switch into other prescribed values upon operator command.

It is also an object of the present invention to provide a multitone musical keyboard (providing more than 12 pitches per octave) that will maximize the instant tuning system in a manner superior to that which the common Cristofori keyboard is capable of.

These and many other objects and advantages will be readily apparent to one skilled in the art to which the invention pertains from a perusal of the claims and the following detailed description of preferred embodiments when read in conjunction with the appended drawings.

BACKGROUND

Musical instruments use: 1. Sound selection devices to allow users to engage distinct pitches. 2. Wave propagation means to generate frequencies.

There are two great divisions of musical instruments; those termed fixed pitch, and those termed infinite pitch. The sound selection devices of infinite pitch instruments such as violins or trombones are able to provide an infinite number of pitch graduations from half step to adjacent half step. The fixed pitch instruments have sound selection devices that are crafted to provide only a finite collection of pitches, and these latter types are the primary focus of this instant art. Preferred embodiments of this invention typically provide a set collection of fixed pitches on operator command.

For musical instruments, wave propagation means may be further divided into two categories, pure acoustic and electricity enabled. Acoustic instruments employ resonating means for sound wave variations, and electricity enabled instruments utilize electronic generated means for sound wave variations. One typical example of electronic generated means is found in electronic keyboards, which can have virtual oscillators that are the object of command. These oscillators are activated, altered, amplified, and made audible by the electrical action of microprocessors.

The resonating means of acoustic embodiments fall into various categories according to the four general families of instrument involved:

1) Contained reed instruments. Soundholes are the selection devices, and the chambers containing the reeds are the resonating means. The operator selects between a plurality of soundholes to excite the contained reeds to the selected frequencies. An example is a harmonica.
2) Column of air instruments. The valves or toneholes produce individual frequencies or elements in conjunction with the quality of air vibrations forced into the barrel. The valves or toneholes serve as selection devices, and the barrel containing the resonating air serves as the resonating means. The operator must choose which selection device to activate to produce a particular tone, whether by uncovering one particular tone hole, or by inserting or removing a length of tubing with a particular valve.
3) Fretted stringed instruments. The frets serve as selection devices when acting in concert with the strings, since they are employed as length controlling means for the strings. The nut is a specialized fret when the string is used open. The neck of the instrument immobilizing and holding the strings at pitch is the resonating means. For instance with a guitar, the box at the bridge end is there to provide sound amplification, not resonance.
4) Open stringed instruments. In this class the plurality of strings are not fretted, but in essence do have one static fret serving as a nut. Collectively the strings furnish a palette of frequencies for the operator to choose between. With a harp or piano example, the plurality of strings serve as the selection devices for tonality, and the frame provides the means for resonance. A misconception about pianos is that the sounding board is the means of resonance, when in fact it is mainly a means of amplifying the volume. A loose string is useless. It is the means that stretches and holds the string at pitch that actually allows it to resonate when struck.

Contained reed and column of air instruments can both be termed wind instruments. Also, other miscellaneous fixed pitch instruments such as xylophones exist and should not be ignored, but are not categorized herein.

Multitone instruments allow more than 12 pitches per octave. Most instruments of the current age are chromatic, not multitone. Some, such as harmonicas provide as few as 7 initial diatonic pitches per octave. Special embodiments are thus included to allow instruments with from 12 or less pitches per octave to have a plurality of the tone producing devices alter or exchange initial tones by operator selection to enable a multitone effect.

The invention does not lie with a particular type of tone selection device, of which there are many, but rather more as the defined relationships of a plurality of these devices acting in concert to provide a scale. A prior art instrument (configured to produce the 12 tone equal temperament politone) is incapable of producing bicameral tuned pitches by the distinct arrangement of its tone selection devices. Comparing a prior art acoustic guitar and the instant art acoustic guitar, the critical point to discern is that the interrelationships of the tone selection devices (frets) producing the prescribed frequencies are unique to both instruments, although the resonating means for both instruments are exactly the same.

DEFINITIONS

Tritone: An interval found in chromatic (12 member) tuning systems that describes the relationship between the tonic (0 cents) and the sixth chromatic interval (600 cents in the equal temperament system) as measured from that tonic. Although the term tritone refers to an interval, by itself it does not name the actual pitch sounded. A particular note in a particular scale can be termed a tritone note, i.e. in the key of C the tritone interval is expressed by the pitch F#. A tritone is three whole tones.

Tone-string: A sequential collection of pitches stretching theoretically to infinity. However, the limits (length) of the tone-string may be stated. The interval linking the ascending or descending members (or 'stations') of the tone-string is repeated from component to component. The term 'linking interval' is an abridged term for this linking tone-string interval. An example is a four member tone-string using diatonic perfect fifths as the linking interval: 0 cents, 702 cents, 1404 cents, 2106 cents.

Bicameral: Two separate tone-strings that share the same linking interval. As a point of reference between separate tone-strings, the interval separating two designated stations (one element from each tone-string) is termed a rung interval. The tritone interval is the rung interval for the preferred embodiment. The term 'rung' is apt because when represented on paper, a typical bicameral table of values resembles a ladder. If one of the opposite pitch intervals from the ladder of values is subtracted from the other, a tritone value is revealed as the rung interval.

Chromatic numbering system: A direct means to identify the 12 individual members of a chromatic collection of pitches, relative to their use as modulating intervals. The tonic is called the 0 degree, the 1st half-tone above it is termed the 1 or 1st degree, the 1st whole tone above it (the major second of the diatonic numbering system) is termed the 2 or 2nd degree, the 1st tone and a half above it (the minor third of the diatonic numbering system) is termed the 3 or 3rd degree, the 1st two whole tones above the tonic (the major third of the diatonic numbering system) is termed the 4 or 4th degree, etc. until the 12th interval is reached, which is the ascending octave to the tonic 0. This chromatic degree nomenclature is sometimes used herein for precise naming of intervals as an alternative to (or together with) the seven common diatonic interval names. This avoids introducing potentially confusing pitch-naming terms such as flat and sharp when describing the five traditional accidental intervals of the major scale.

Octave regulation: The conversion of tone-string members exceeding 1200 cents or less than 0 cents (such as negative values like −702 cents) to a cent value falling between the tonic and the ascending octave of the tonic. This is done by subtracting (or adding) 'X' cents (usually 1200)

or multiples of 'X' cents from some values in the tone-string until the octave values appear with a positive cent value falling somewhere between 0 and 1200 cents. Thus the cent values of the five members of the tone-string (−702 cents, 0 cents, 702 cents, 1404 cents, 2106 cents) when octave regulated become 498, 0, 702, 204, and 906. When referred to as members of a defined scale, out-of-range components of an octave regulated tone-string are usually transposed up or down into the octave contained above the tonic. For the example last given, the home pitch of the 498 value sounds in the octave below the tonic 0, but finds itself in size-sequential order when given as a member of a defined scale (i.e. 0, 204, 498, 702, and 906).

Defined scale: A non-equal temperament collection of octave regulated intervals ascending above a known reference pitch and generating a known family of intervals in size-sequential order. One with 12 intervals (loosely corresponding to the traditional 12 tone's scale intervals) is termed a chromatic defined scale. For instruments such as keyboards capable of producing more than 12 notes per octave, a multitone defined scale (expressing more than 11 pitches relative to the tonic pitch) has enharmonic values appearing as real-time alternatives to the original. However, for a typical chromatic instrument such as a guitar in bicameral configuration, a defined scale is always chromatic (i.e. expressing 11 pitches relative to the 0 tonic pitch for a total of 12 pitches). In the bicameral system, a chromatic defined scale usually uses six values from one tone-string, and six from the other; a condition termed sesatonic. Any variation of this would have the consequence that at minimum one of the six tritone pairs of the defined scale would not be separated by the same rung interval as the rest, which would also destroy the symmetry of the six modal scales.

Bicameral modal scales: The six different defined chromatic scales possible with six sesatonic tritone pairs sharing the same rung interval. The seven white fingerkeys of the common piano provide seven diatonic modes, depending on which of the seven is considered the tonic. In the same way, the twelve bicameral pitches provided by six contiguous tritone pairs allow for six unique scales, or chromatic modes. Since any tritone pair can have either one of its two values selected to be the tonic, octave regulation on an initial collection of 12 chromatic pitches produces only six different defined chromatic scales. All six of these scales have a unique anatomy and unique characteristics. The most important member of the six is termed the straight major scale, and it is preferred because of its audible merits. Musicians may choose as a matter of course to employ other scales provided by the bicameral system, including the five other modal scales. However, as the best example for illustrative purposes, only the straight major scale will be detailed in this specification. It has the cent values: 0, 102, 204, 294, 396, 498, 600, 702, 804, 896, 996, and 1098.

Tonal center: A pitch station of a defined scale that can become the 0 or tonic of a new scale. Unless otherwise desired, ideally the new scale displays the same harmonic attributes as the defined scale itself. If it does, the new scale is thus termed an isomorphic (same structure) scale. In preferred sesatonic embodiments, a 12 member defined scale allows two tonal centers of the twelve (the tonic and the tritone) to either serve as the tonic for the same isomorphic scale. The other ten tonal centers are termed the modulating tonal centers. In order for a scale built on a modulating tonal center (once again of a non-equal tempered scale) to be isomorphic to the defined scale, there must either be enough enharmonic pitches available in the collection to allow this, or some components of the collection must be switchable into the desired enharmonic pitch. This desired pitch is termed the foreign pitch. The original pitch it replaces is no longer needed to establish the isomorphism, and is termed a superfluous pitch. The reverse procedure is termed recursive, and exchanges one or more (usually two) foreign pitches back again for one or more superfluous pitches.

Shift interval: The interval distance between a foreign pitch and a superfluous pitch. In the preferred embodiment, the shift interval is 11.7 cents. The dependence on how many of the defined scale pitches are required to become potential tonal centers (and thus display isomorphism) dictates the final composition of what is termed the full scale.

Full scale: A collection of pitches sufficient to allow a defined scale or a plurality of defined scales (a complex scale) to be employed with isomorphism on a particular subset group of pitches designated to be tonal centers. Two defined scales needed by a tonic to fashion a complex scale would typically be an optimized major scale and an optimized minor scale.

Tritone pair: In the preferred bicameral tuning system, two members of the full scale that are separated by the tritone interval (a preferred 600 cents as measured from either of them to the other). When 600 cents apart, together they hold the unique property of allowing certain defined scales to be played with isomorphism on either of them interchangeably. A defined full scale contains a minimum of six tritone pairs. A defined chromatic scale contains a maximum of six tritone pairs, and is thus a subset of the full scale that it is derived from.

DETAILED DESCRIPTION OF DRAWINGS

FIG. 1 shows a complete octave regulated 24 member chart of the required pitches for an embodiment of the bicameral tuning system relative to one pitch (0) designated as the reference. If looked on as a ladder of values reduced to two dimensions, this chart shows two octave regulated Pythagorean perfect fifth tone-strings rising from bottom to top. For example, 588, 90, 792, 294, etc. are elements of the tonic tone-string, and 1188, 690, 192, 894, etc. are part of the tritone tone-string. In this chart each of the two tone-strings are composed of 12 members. Any given pair of two horizontally aligned elements bearing a tritone relationship can be contemplated as the key signature tonic group for any six vertically consecutive tritone pairs of which it is a member. Together with the next most uppermost consecutive tritone pair, and the next most lowermost consecutive tritone pair, this total of 16 pitches is suitable for many typical three-chord musical compositions featuring the straight major scale. For further insight, each value is assigned a chromatic number in parenthesis to the right of the cent value. In the chart, T1 subgroups the 16 pitches necessary for the zero degree tonic and the sixth degree tritone to be used as a basic key signature. The inner core 12 values are 894, 396, 1098, 600, 102, 804 in one string, and 294, 996, 498, 0, 702, 204 in the other. For T1, the highest placed two pitches in the two columns (906 and 306) and the lowest placed two pitches (792 and 192) are omitted when the 12 pitches needed to play the chromatic straight major scale are used based on the tonic group. By initially replacing the next to bottom components (294 and 894) of the 16 pitches of T1 with the highest placed components (906 and 306) as the chosen values for the ninth and third degrees, the revised 12 pitches can successfully play the straight major scale with isomorphism on the dominant group. By initially replacing the next to top components of T1 (204 and 804) with the lowest placed components (792 and 192) as the chosen values for the eighth and second degrees, the revised 12 pitches can successfully play the straight major scale with isomorphism on the subdominant group. T2 is the subgroup for the 2nd and 8th degrees used as the basic key signature tonic, T3 is for the 7th and 1st degrees, T4 is for the 5th and 11th degrees, and T5 is for the 10th and 4th degrees. With an instrument providing one or several tritone pairs in addition to the three (tonic, dominant, and subdominant) basic groups, more developed musical scores can be performed than with typical three chord songs.

FIG. 2 shows a nine-tiered configuration for three octaves of an enharmonic keyboard suitable for bicameral music. Fifteen columns of fingerkeys (not shown) would provide seven octaves. The chromatic degrees are superimposed for clarity at the left in the rectangular key-surfaces, and the pitches in cents are shown to the right without octave regulation. For further orientation, the pitch value for the tonic key signature (0) has been arbitrarily assigned the pitch value C, and this and the other traditional letter-name values derived from C are shown in the central position of each fingerkey rectangle. The fingerkey values in each column rise by 102 cents, and the value of any horizontal fingerkey to the right increases by 600 cents. An octave repeat (1200 cents) for any given fingerkey lies two keyspaces away in a horizontal direction.

FIG. 3 shows a perspective of the keyboard of FIG. 2. The hand is chording an ascending major triad (0,4,7) with an added 11th degree (a diatonic major 7th), and an added 2nd degree raised an octave above the tonic (a diatonic 9th). This particular fingering is based on the straight major scale, where the diatonic major third is 396 cents above the tonic. The wrist has been angled up and to the right to allow a view of the fingers. With normal playing posture the wrists are positioned at more parallel angles to the playing surface in a more comfortable fashion. The compact layout of the fingerkeys allows even a small handed person to achieve this example of a desirable voicing with either hand on this instrument.

FIG. 4 shows a fingering layout of the chord being played by the hand depicted in FIG. 3. The root note is 0=C, so this is a C derivative chord. The other pitches are 4=E, 7=G, 11=B, and 2=D raised an octave.

FIG. 5 also shows a fingering layout of an ascending major triad with an added 11th degree, and an added 2nd degree from the next highest octave above the tonic. This particular fingering is different in shape because it is based on another of the bicameral modal scales, where the diatonic major third is 408 cents above the tonic. This is technically (by interval names) the same chord as played in FIG. 4, but sounds different because this particular modal scale has different intrinsic intervals than the straight major. However, each scale can be considered to be acoustically proper for its own application. Since this modal fingering has its root on the 9th degree under simultaneous conditions where the straight major has its own modal root on the 0 degree, and the original key signature was C; then the 9th degree (in the octave below the tonic) is an A note, and this is an A derivative chord. The 1=C# pitch serves as the diatonic 3rd, 4=E serves as the diatonic fifth, 8=G# serves as the diatonic major 7th, and 11=B serves as the diatonic 9th. This particular mode seems to suffer from the sharp 408 cent major third, but can be useful as an optimized minor scale.

FIG. 6 is a depiction of a note-fret layout from the nut T6 through the 12th note-fret positions for a basic bicameral guitar. This layout is for the key signatures E major and A# major. Under each string at any given fret position lies an independently-placed small note-fret positioned to generate a precise pitch for that string if activated. A given scale position can generate two possible cent values depending on whether the anterior note-fret or the posterior note-fret is lifted, while the other is submerged. Submerged note-frets (not shown at this resolution) generate a pitch 11.7 cents different from the lifted position. In the illustration, each lifted note-fret is given the common musical name for reference, and may or may not align with adjacent note-frets in a straight line across the breadth of the fretboard. Viewing the second fretline from the nut, the C# position is offset (in a flat direction towards the nut) from the adjacent note-frets.

FIG. 7 is the same neck as in FIG. 6 with the note names removed for better observation of the distinctive fret pattern exhibited. This drawing is not to scale, but designed to show the relative positions of the various lifted note-frets to each other. On any fretted instrument, as one moves up the neck (towards the bridge), the overall fretlines move closer together uniformly. This natural phenomenon is exhibited by the distances between the offsets as well. For example, the offset distance at the 2nd fretline T7 from the C# pitch and the fretline of the other five values is roughly 4 mm. One octave up the neck at the 14th fretline (not shown), this same distance will have dropped by half. Precise locations are deduced by common auditory laws. For example, a B pitch of 702 cents on the E string is a perfect fifth, and is located ⅔rds of the string distance from the bridge to the nut. This law is so precise that a perfect fifth is called a ⅔ ratio (or 3/2), and dates back to Pythagoras. Other intervals have similar precise ratios.

FIG. 8 shows the neck of FIG. 7 after a modulation to the dominant. All the G and C# notes have sharped by 11.7 cents. Note that the overall visual pattern of the offsets exhibited by the note-frets is maintained, but has uniformly advanced up the neck (towards the bridge) by one fretline. For example, the single B string offset (sounding pitch C#) formerly exhibited by the 2nd fretline is now exhibited by the 3rd fretline; the A, D, G string offsets (respectively sounding pitches C, F, and A#) formerly exhibited by the 3rd fretline are now exhibited by the 4th fretline; etc.

FIG. 9 shows the neck of FIG. 7 after a modulation to the subdominant. All the F# and C notes have flatted by 11.7 cents. Note that the overall visual pattern of the offsets exhibited by the note-frets is maintained, but has uniformly advanced down the neck (towards the nut) by one fretline. For example, the single B string offset formerly exhibited by the 2nd fretline is now exhibited by the 1st fretline, the A, D, G string offsets formerly exhibited by the 3rd fretline are now exhibited by the 2nd, etc. With the guitar initially setup as in FIG. 7, and with the power to shift the indicated note-frets on command to the two positions shown in FIG. 8 and in this drawing FIG. 9; a guitarist can play any three-chord (tonic, dominant, and subdominant) musical piece holding either the key signature of E major and A# major utilizing the straight major scale with isomorphism. Other key signatures have other initially lifted fret-position setups.

FIG. 10 shows a complete full scale note-fret layout for a bicameral guitar at a resolution to allow both anterior and posterior note-fret positions to be shown. The two dozen different cent values employed are the same as listed in FIG. 1, and are shown along the left of the neck for each of the two enharmonic note-fret positions for the large E string only. Also for further reference, the note-fret positions required to be in the initially lifted position are labeled with note names for the major musical keys of E and A#. This means that if these labeled pitches are all in the lifted stage, a straight major scale can be employed on either pitch E or A# as the tonic. The individual note-frets have the ability to rotate between two positions, so this instrument can generate all of the 24 pitches shown in FIG. 1, but only 12 particular ones at any given instant. This two-positional ability of the note-frets is shared by the nut itself, but the posterior position T8 is never submerged. The anterior metallic note-fret T9 when lifted high enough to engage the string effectively shortens the string length to the proper value. Every 7th note-fret towards the bridge from a given reference note-fret repeats the exact positioning (but not the pitch name) of the reference. For example, the first note-fret T10 (sounding F) has a duplicate setting at the 7th note-fret T11 (sounding B, which is the tritone value to F). This means the entire physical aspect of the first six fretlines is repeated beginning at the 7th fretline, and is again repeated beginning at the 13th (not shown) and (if necessary) the 19th (not shown).

FIG. 11 shows another view of the guitar neck illustrated in FIG. 10. A solid pulley-line T13 connects all of the E values and A# values, as they are together a tritone pair. The two ends of T13, shown as T12 and T14, connect to a magnetic mule (not shown) that has the power when activated to draw pulley-line T13 in one direction or the other, effectively lifting or submerging required enharmonic values of E and A# as required by the operator. The other five tritone pairs are also ganged together on five other similar pulley-lines (not shown) to be engaged as needed by the operator.

FIG. 12 shows a perspective blowup of a two-position note-fret mechanism for a guitar neck. The anterior fret T17 is shown lifted by pivot T18, which submerges posterior fret T19 as shuttle T16 passes underneath and physically moves the hinge. To enable a smooth pull, fixed rollers T20 and T22 guide pulley line T13 as required, which slides freely through a hole in shuttle T16. The anterior position depicted for shuttle T16 was brought about by the anterior tugging of the pulley line T13 in the direction of the arrows toward the bridge (not shown). An unseen stopblock (similar to visible stopblock T21) has reached the rear unseen side of shuttle T16 and pulls it along inside housing box T15. For clarity, the anterior wall of housing box T15 is not shown to enable a view of shuttle T16. Mass moving means (not shown) engage and move the shuttle depending on the direction of the movement of the pulley line. In a flat direction, stopblock T21 would run up against the anterior side of shuttle T16 and would propel it back under fret T19, lifting it and causing Fret T17 to submerge. The entire box and contents is positioned in the neck of the guitar with dozens of others, each at a precise location, and each so small that plenty of neck terrain is left for a fingertip to engage a string posterior to a box and cleanly sound either of the two possible pitches produced by the see-saw action.

FIG. 13 depicts a side view of a ganged pair of two-way fret actions T42 and T18, either capable of enabling two different enharmonic guitar string lengths to be sounded for a string T24 shown hovering right above both the lifted note-frets. Only two pivoting hinge mechanisms T42 and T18 are shown activated in the sharp position by pulley line T13, but a dozen or more pivot mechanisms (not shown) are actually activated by this pulley line. In its entirety, the nature of pulley line T13 can be seen better in FIG. 11, and pivot hinge-mechanism T18 can be considered as any note-fret labeled as E or A# in FIG. 11. This is because every member of a particular tritone pair is ganged along the same pulley line so they can all be flipped to the flat or sharp positions together. A perspective view of pivot T18 and its mechanisms is shown in FIG. 12. Viewed in isolation, note-frets T17 and T19 use a see-saw action over pivot T18. Stopblock T23 was pulled flush against shuttle T16, moving it underneath Fret T17, and causing it to rise as depicted. For proper view of the apparatus, a gap is illustrated between shuttle T16 and the support arm of fret T17, but in actuality they are in physical contact. Shuttle T16 slides along the floor of a housing box T15, of which for clarity the walls are not shown. When pulley line T13 is activated in the other (flat) direction (not shown), stopblock T21 will engage the shuttle and move it under note-fret T19 to lift it. The north magnetic pole of mule T25 has been drawn by magnetic attraction to the south field generated by coil T26 when the processor T27 through amplifier T28 momentarily threw one-pole relay T29 from the off position depicted. The activation of relay T29 (shown unactivated) would allow positive direct current to flow through off-status (non-activated) double-pole relay T30, through both coil T26 and coil T31 (generating a south field in proximity to both ends of mule T25), and back out through relay T30 to ground. When required to also be activated for the reverse process, relay T30 is powered through amp T43 under command of processor T27. Triangle lock T32 is attached to minimule T33, which are both identical in function to triangle lock T34 and minimule T35. When current moves through relay T29, the double action (one field pushes and one field pulls) of the two coils T26 and T31 propels mule T25 to coil T26 by magnetic forces, where triangle lock T32 has been thrust into notch T36 by spring action (not shown), signaling (not shown) the processor to cut the current. At this point in the illustration, the note-frets are held in the anterior lifted position by lock T32, and no current is moving through relay T29. Processor T27 is prompted when the operator places the heel of a foot on heel rest T37 and depresses combinations or individual pedals of the fanned arrangement of a central footpedal between side pedals T38 and T39. The processor T27 accesses a table of values T40 over bus T41 to determine which relay or relays to activate to follow pedal command. The 24 values in T40 are subdivided into flat and sharp values, and correspond to the 24 pitches listed in FIG. 1.

FIG. 14 shows FIG. 13 after the posterior note-frets are lifted. For this reverse procedure, the processor momentarily activates both relays T29 and T30 as depicted via amplifiers T28 and T43 respectively, allowing positive current to flow throw coils T31 and T26 in the opposite direction from the route used in FIG. 13. This causes a north magnetic field to appear in proximity to both ends of mule T25. At the first instant, lock T32 is pulled from notch T36 by the movement of south magnetic minimule T33 to coil T26, which then allows unlocked mule T25 to approach coil T31 to the left. As the empty notch T36 reaches a point directly over lock T34, the lock is thrust up into notch T36 by spring action (not shown), which secures the position of the note-frets to the flat lifted positions depicted in this illustration and again signals the processor to cut the magnetic current through the relays. Table of values T40 lists as example all note-frets for the 6th chromatic degree (the pitches 510 cents in sharp position and 498 cents in flat position) together with all the note-frets that generate the 12th degree values (1110 cents in sharp position and 1098 in flat position). These tritone pitches are collectively controlled by one pulley loop attached to one mule. The other values for the other five two-way note-fret tritone pairs are listed in table T40, and each are similarly connected (not shown) to a collective mule. For flexibility, either extra programming to determine which three adjacent tritone pairs are commanded by the triggering means (in this case footpedals), or a greater number of pedals must be provided to allow an operator to individually trigger all six tritone pairs as needed.

FIG. 15 is a tone chamber T44 for a harmonica. Air is pulled through slot T45 over reeds T46 and T47. Damper T48 controlled by key-arm T49 mutes one of the two available pitches separated by 11.7 cents. Another two reeds turned in the opposite direction are at the blowing end T50 of the chamber to provide another two pitches, one of which is always damped by similar means. This particular chamber thus offers the operator two separate pitches at any given instant, selected by either blowing or pulling.

FIG. 16 shows a perspective view from a slanted bottom angle of the tone chamber of FIG. 15 with bottom T51 in place. This is done to clarify the perspective of FIG. 15 and to clarify the dimensional orientation of the vibrating reeds. Bottom T51 is removed in FIG. 15, together with the chamber sides (not shown) that immobilize the rear portions of the reeds.

FIG. 17 shows a one octave 13 pitch chromatic harmonica from a top perspective view, with the top removed. This simple instrument lines up eight tone chambers left to right providing a 7 member natural scale when blowing air, and allows five accidentals to be introduced by pulling air. This instrument is calibrated to play the straight major chromatic scale, and is shown with C key signature elements for orientation. While playing tonal centers of the tonic group, no alteration of the 13 pitches is required. Damper button T52 is kept pushed out by spring T53 at the opposite end of bar T49. Similarly damper button T54 is kept pushed out by spring T55 at the opposite end of its own damper bar. To identify the particular tone chamber shown in FIG. 15, damper T48 and pull slot T45 are shown in situ. T56 is the list of blowing values and T57 is the list of pull values.

FIG. 18 shows the aftermath of the operator enabling the dominant group of tonal centers. Damper plunger T52 has been depressed, and is held by the locking edge of recursive release plunger T58 resisting the return push of spring T53 along bar T49. The two required foreign pitches have now been introduced into the chromatic elements to allow the straight major chromatic scale to sound with the desired isomorphism on the dominant group (in this case G and C#). For an example of one pitch change, damper T48 now mutes the reed formerly sounding 294 cents (T47 as seen in FIG. 15) and allows the reed sounding 306 cents (T46 as seen in FIG. 15) to play the C scale accidental (the diatonic third, or in this case D#). This is reflected in list T57, where this pull value is now 306. Blowing list T56 also shows a 906 cent value reflecting the movement of the local damper.

FIG. 19 shows the aftermath of the operator enabling the subdominant group of tonal centers. Damper plunger T54 has been depressed, and is held by the locking edge of recursive release plunger T58 resisting the return push of spring T55. The required foreign pitches have now been introduced to allow isomorphism on the subdominant group (in this case F and B). This is reflected in list T57, where the effected pull value is now 790. And blowing list T56 now shows a 192 cent value reflecting the movement of the damper away. In either this case or as shown in FIG. 18, a push by the operator on recursive release plunger T58 frees the locked damper bar and allows the respective spring to return the instrument to the starting tonic arrangement of tones.

FIG. 20 shows a generalized chromatic woodwind instrument. The physical distance a stream of air moves from the mouthpiece to exit tone hole T59 to produce a 1200 cent octave tone is half the physical distance the airstream would require to sound the fundamental 0 cent pitch. The other 11 chromatic notes are placed at graduated positions sufficient to generate the straight major chromatic scale of pitches as listed beside each tone hole. The eight pitches providing the natural scale (including the fundamental and its octave) are stopped by the four fingertips of both hands (not shown), while the thumbs are placed along the ventral surface. The right hand is closer to the mouthpiece, and is positioned to allow the right thumb to depress a choice of five mechanical lifting levers, one of which is labeled as T60. When depressed, these levers individually lift a cap off the 5 accidental tone holes. The pitches are indicated to the left of the barrel.

FIGS. 21 shows a tone hole T61 in a movable segment T62 of a wind instrument. The segment may slide further down the barrel T63 either by manual or by levered combinational action. This means that an instrument such as a flute or clarinet can have certain selected pitches readjusted by 11.7 cents. In the drawing, lever T64 maintains tone hole T61 at a particular distance from tone hole T65. This position is for the tonic group element.

FIG. 22 shows the drawing of FIG. 21 after the segment T62 has been pulled closer to tone hole T65 by the mechanical action of lever T64. The exposed section of the barrel T63 is now shorter than the previous position of FIG. 21. This position is for the dominant group element.

FIGS. 23 shows the instrument of FIG. 20 with the five accidental lifting levers removed to allow a view of included pitch shifting mechanisms as seen in FIGS. 21 and 22. The thumb of the left hand (not shown) is able to slide lever T66 away from the mouthpiece, which flats two attached movable segments. This provides the two correct foreign pitches, and thus enables the subdominant group of tonal centers. A frontal view of this subdominant shifting process is shown in FIG. 25. Pulling slide lever T67 displaces lever bar T64 towards the mouthpiece and shortens the length of the related air stream reaching the associated tone holes of two other movable segments, one of which is movable segment T62 of FIGS. 21 and 22. This sharp movement provides the correct foreign pitches, and thus enables the dominant group of tonal centers. A frontal view of this dominant shifting process is shown in FIG. 26. Because the levers move in opposite directions, typical push-pull grappling hooks (not shown) can pull the opposing lever back to the tonic position if for example lever T67 is engaged after T66 had been pushed earlier to the flat position. This prevents the two variations from ever both being engaged at once.

Figure 26:
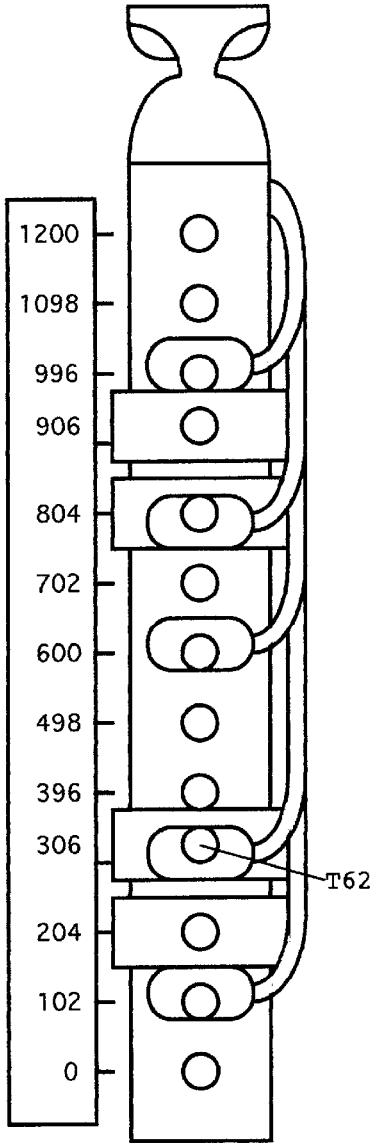

FIG. 26 shows a frontal view of the same instrument after enabling of the dominant foreign pitches, and lists the current chromatic values. The related movable segments are physically moved to the sharp position. As such, movable segment T62 when engaged as detailed in FIG. 22 provides a 306 cent pitch, as opposed to the tonic position 294 cent pitch as detailed in FIG. 21. The other movable segment ganged with it provides the sharp pitch 906 cents when engaged as shown, and 894 cents when disengaged.

Figure 27:
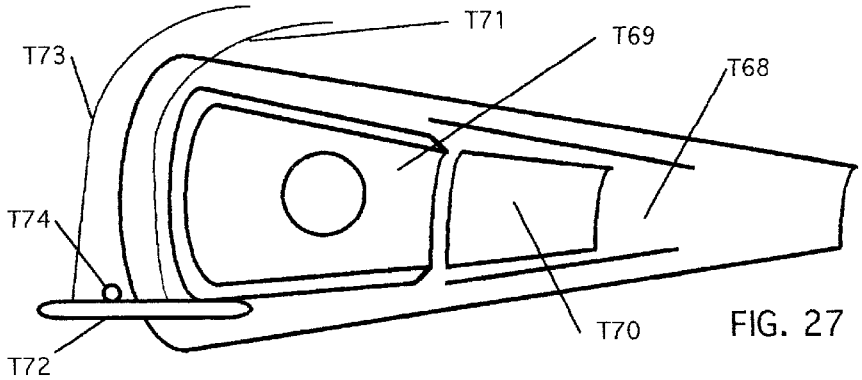

FIG. 27 shows a cut-a-way of the interior of a wind instrument barrel T68. Movable mask T69 with a central hole covers a larger opening T70 cut in the barrel T68. For illustrative purposes the mask has been moved to the left of T70, which it normally covers at all times. A locking lever (not shown) when depressed by the operator can shorten draw line T71 and lift bar T72. As bar T72 rises, mask T69 is thrust to the right, which relocates the tone hole in the center of the mask to a position 11.7 cents further down the barrel. A retrograde spring action (not shown) keeps the crown of bar T72 tightly pressed against the lower corner of the mask. When the player disengages the mask, another operation lever (not shown) tightens line T73, which uncocks bar T72 over pivot T74, and allows the spring to slide the mask back to the starting position. This apparatus is designed to allow a player in real time performance to selectively lift or drop a particular pitch emerging from a tone hole by the required 11.7 cents. This alternative movable-mask system is more elegant and less bulky than the simple shifting method of FIGS. 21 and 22, which utilizes a movable outer barrel encapsulating and moving along the exterior of the inner barrel.

Figure 28:
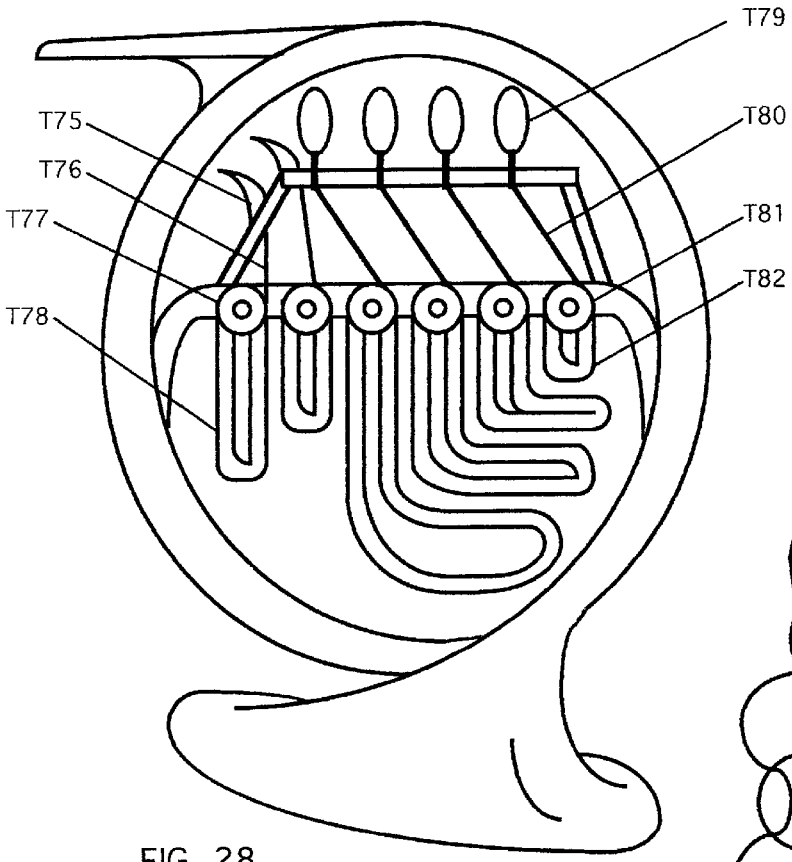

FIG. 28 is a valved French Horn equipped with six rotor assemblies running from left to right first as two thumb wings and then as four finger spoons, all aligned for the left hand. The leftmost thumb wing T75 draws string T76 to spin rotor T77 and routes airflow through loop T78, dropping the pitch in this case 39.9 cents in certain combinations. The rightmost finger spoon T79 operates in similar fashion via string T80 to spin rotor T81 and open the knuckle T82, dropping the sounding pitch by in this case 11.7 cents in certain combinations. This horn operates with typical prior art mechanisms, and it is the tone selecting means, i.e. valves controlling loops configured to sound bicameral tones, that make this horn novel to the art.

Figure 29:
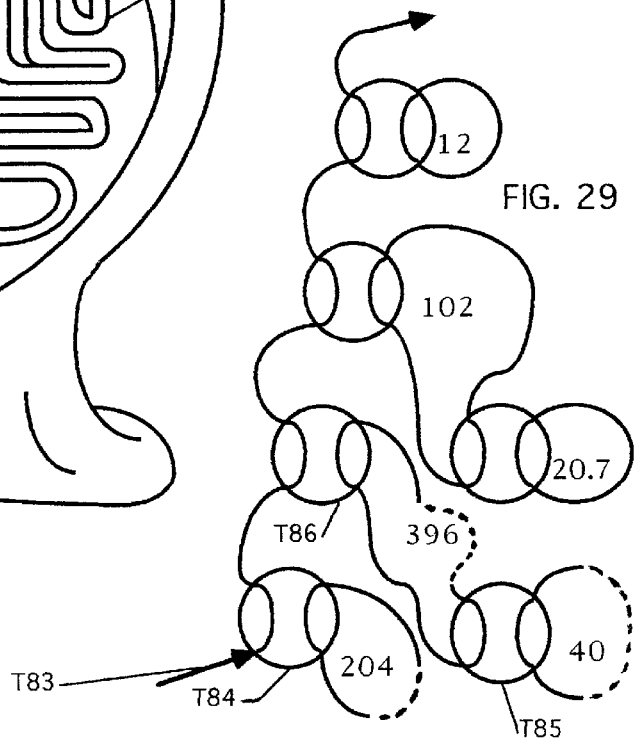

FIG. 29 shows replacement of the two thumb wing rotor valves with compensating loops. Air enters T83 of double valve T84 and T85. If opened, only the 204 cent loop is added. If double valve T86 is opened, only the 396 cent loop is added. If opened in tandem, the 40 cent loop is also added.

THE PREFERRED BICAMERAL CHROMATIC SCALE

To analyze the construction of the preferred 12 member bicameral scale, a reference pitch 0 is selected. First, five Pythagorean fifths are designated above this reference pitch. Then (by changing cent values) the same frequencies are labeled again. For example, a six member tone-string of pitches is generated to the right of the initial tonic 0: 0, 702, 1404, 2106, 2808, 3510. By designating the fourth value (2106) a 0 cent value (by subtracting 2106 cents from all six values), the tone-string is converted into a tonic placed with two perfect fifths above it, and three negative values below it. However, the six distinct underlying pitches are still the same, but now are labeled like this: −2106, −1404, −702, 0, 702, 1404.

When octave regulating this string of values into a visually recognizable ascending scale, the equivalent values for the non-octave components are individually computed: 1404−1200=204, 1200−702=498, 2400−1404=996, 2400−2106=294. All the values can then be put in size-sequential order (the ascending order above the tonic): 0, 204, 294, 498, 702, 996.

Similarly, a tritone value of 600 cents is used to build a second tonestring of values. This is done by determining two perfect fifth values above this reference tritone value, and three negative values extending below it.

By octave regulating this string as before, another series of size-sequential values is revealed: 102, 396, 600, 804, 894, 1098. Taken together, the six members of the first interval series combined with the second six member interval series gives a twelve member scale of values. These twelve values are displayed in size-sequential order as follows: 0, 102, 204, 294, 396, 498, 600, 702, 804, 894, 996, and 1098.

In similar fashion, five other defined chromatic scales can be fashioned from two sesatonic series of Pythagorean fifth intervals as was just done. Together they are the six modal chromatic scales. The twelve underlying frequencies sounded for all six modes can be considered constant. Two of these scales use 192 for the 2nd degree, which is quite sour when used in combination with the 0 degree, and thus neither scale can be considered as enchanting. Of the remaining three, one provides a nice minor oriented scale.

Chromatic Instrument Tone Shifting

If an instrument (such as a multitone keyboard) automatically provides needed foreign pitches simultaneously and in addition to the superfluous pitches, the player chooses from them as required. This is clearly an uncomplicated process. As evidenced by the basic embodiment of FIG. 2, a typical multitone keyboard can be configured to sound as many pitches per octave as required by increasing the number of tiers as desired.

Non-keyboard instruments with a maximum of only 12 octave pitches at any given instant can also be empowered further. The current invention is characterized by the use of shifting to provide a basic full scale of 16 pitches for monophonic (horn), diatonic (harmonica), or chromatic (guitar) instruments. Shifting is the substitutional use of usually two enharmonic notes of a preferred 12 cents deviation from an initial tritone pair of chromatic values of a defined scale. Since these latter instruments do not automatically express enough tritone pairs, then the superfluous pitches must mutate into the foreign pitches under operator control.

Which two particular values are to be shifted depends on musical events, but the operator must make the choice. Since the two particular chromatic positions involved are shifted together, they remain a tritone pair whether foreign or superfluous. Tritone pairs are a convenient grouping of the 12 values of the chromatic scale into six subvalues, each of whose two components always bear a tritone relationship to the other.

If the 12 pitches could not be changed, the anatomy of the defined chromatic scale would change into a different modal scale every time the musician changed chords to a member of another tritone pair. That would be an unmusical situation limiting the audible output of the musician.

An improvement to the above static 12 pitch situation would be to establish more tritone pairs (from the initial collection of six tritone pairs) that could also provide isomorphism for the chosen scale, (i.e. the straight major). The required foreign pitches to do this must be available (either in situ as in keyboards or presented by shifting as in guitars) if the chosen defined scale is to be preserved. Monophonic instruments such as flutes can be constructed with the ability to produce the foreign notes on command as the physical positions of the holes on the barrel are altered.

Figure 24:
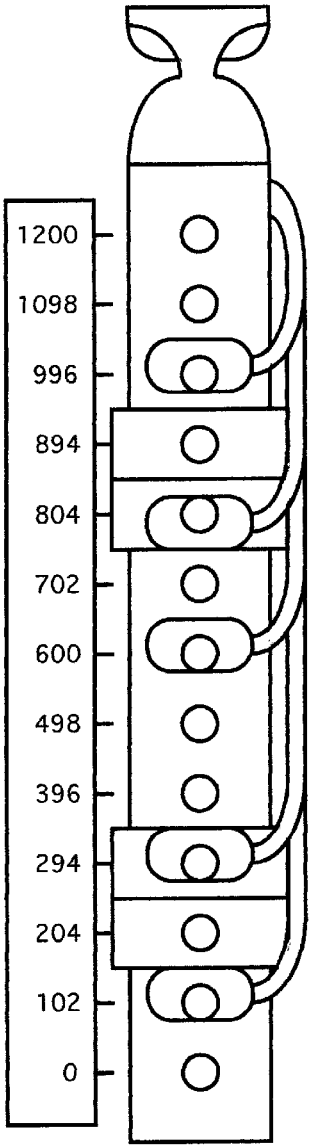
FIG. 24 shows a frontal view of the instrument of FIG. 23, also listing the chromatic values of the tonic group.

A 16 member scale can be considered a full scale for certain musical works that never modulate (change chords) beyond the dominant or subdominant (i.e. the typical three chord song). If the tonic sounds a pitch traditionally called a C note, then the other 15 pitches calculated in conjunction with this C reference frequency will work not only in the key signature C, but also in the key signature F# (or Gb), since F# is the tritone value for C. A basic instrument with a 16 pitch compass is shown in FIG. 24.

Since two tonal centers of the twelve can use the original twelve values without modification for a defined scale, these two centers are called collectively the tonic group. Because the dominant (the Pythagorean perfect fifth or seventh degree) is a member of another tritone pair, this group is called the dominant group. The subdominant group contains as its namesake the fifth degree (which is the Pythagorean fourth). This naming is relative to the tonic group, which contains the 0 degree as its prominent member.

At the most basic level, the importance of this subdivision into three modulation groups is that for the key signatures derived from a particular tritone pair, a musician can play many three chord songs on an instrument that only traditionally provides 12 notes to the octave, such as a guitar, if:

1.) a method is introduced by which the frets affecting two notes of the twelve can be sharped on demand by 11.7 cents, and returned to the starting neutral position on demand. This is done to access the dominant group. And;

2.) a method is introduced by which the frets affecting two different notes of the twelve can be flatted on demand by 11.7 cents, and returned to the starting neutral position on demand. This is done to access the subdominant group.

Exactly this concept will be further detailed for not only guitars, but any chromatic instrument that uses stepped pitch selection. More powerful instruments would allow modulations to more tritone pairs than the three modulation groups discussed, which would increase the usefulness of the instrument as the full scale grows beyond 16 frequencies. This would allow detailed compositions with extensive modulations to be performed.

Figure 1:
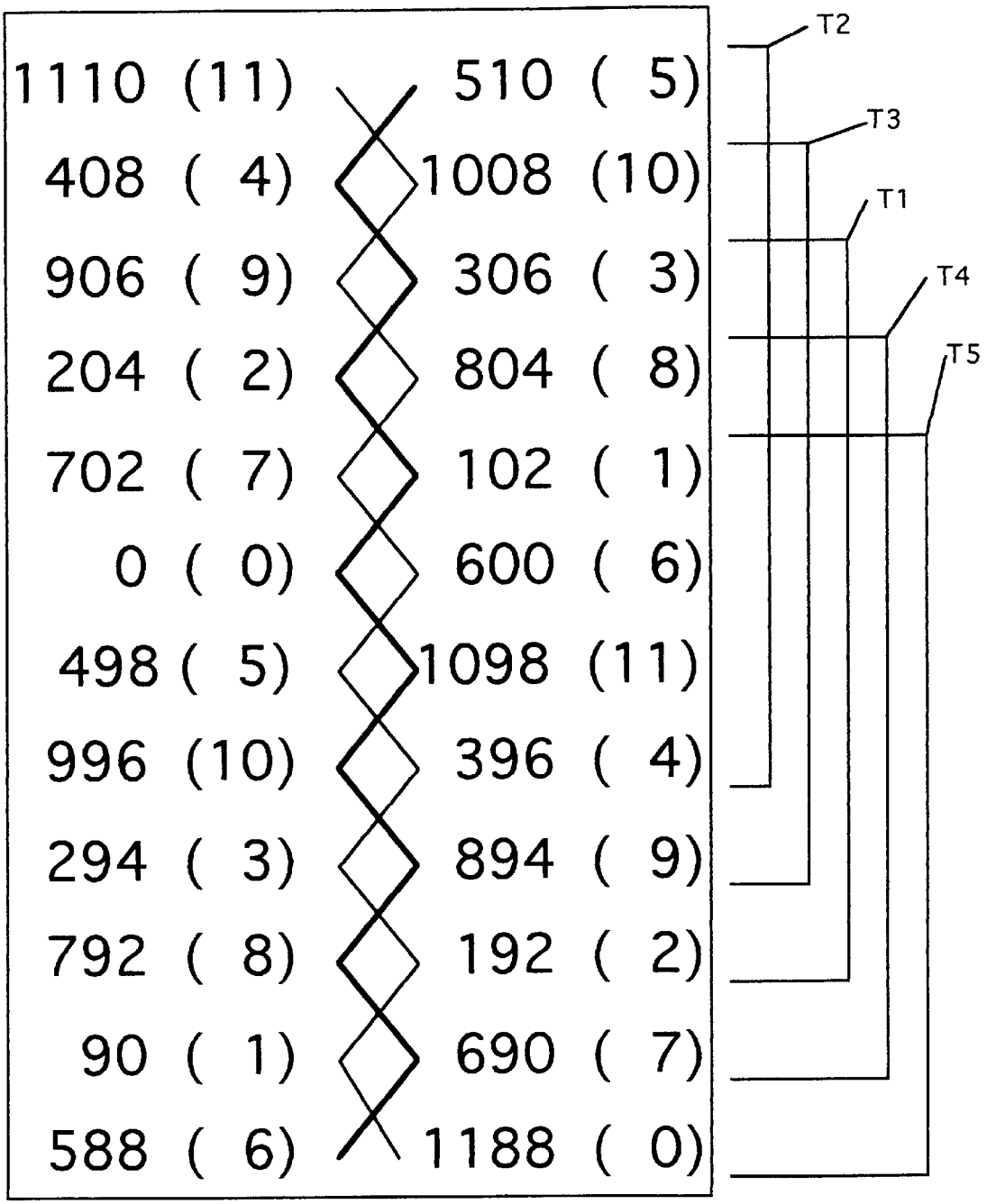

The pitch collection of FIG. 1 has 24 tones, and is suitable for use for example as the full scale for a guitar embodiment. Although enharmonic keyboards are powerful as to the number of pitches they can accommodate, chromatic instruments such as guitars can only provide so many pitches before the shifting fret system gets cumbersome. In this particular instance, two-way frets for each of the chromatic positions allows 24 tones in all. Three-way frets are feasible to extend the compass of the instrument, but would possibly be overkill, and would crowd the fretboard with excessive hardware.

The success of any particular tuning system is a subjective affair dependent on the preferences of the listener. The bicameral tuning system provides a plurality of tones in a 12 member scale that are perfect to just intonation theory such as the diatonic 702 cent fifth, and also moves to improve the sour third problem of 12 tone.

Instruments built to track a chromatic score, but configured to sound bicameral tuning, demand an operator trained to understand modulation and preservation of the desired scale. The extra effort for a player to handle extra tones per octave (beyond an initial 12) is worth the expenditure. Fortunately, at any given instant of time a chromatic piece of music only requires a particular 12 pitches.

The instruments from the various families of instruments to be described will provide the correct pitches when the player follows generalized modulation rules, either transforming a chromatic group of pitches into an enharmonic group on demand, or automatically providing the full scale in the case of multitone instruments such as keyboards.

Keyboards

The common Cristofori keyboard has 12 fingerkeys per octave. As with other traditional chromatic instruments, it can be encumbered with a footswitch affair to enable all of the three basic modulation groups during play. However, it makes more sense to jettison the Cristofori concept and to employ a keyboard that is designed to simultaneously offer all the enharmonic notes that are required for a specified embodiment. This eliminates the need for modulation switching mechanisms entirely. An enharmonic multitone keyboard (with more than 12 pitches per octave present) is desirable because of the user-friendliness, and its ability to handle musical tuning systems with more than 12 tones to the octave.

The basic keyboard of FIG. 2 has wide fingerkeys that are recommended to be approximately two centimeters by four centimeters stepped at a height about one centimeter between the tiers. Since there are only two keyspaces between lateral octaves, sounding octave pitches is no great stretch. Jumps up and down the keyboard are achieved with more accuracy than with the Cristofori key surface, as the landing surfaces are closer and wider.

Fifteen columns of keys would allow a full seven octave range. Although eight tiers (which provides the required 16 notes) are enough to allow three tritone pairs to house the straight major scale, a tier height of nine empowers another two tonal centers. To create a tactile support system to keep a player on track, braille and textured key surfaces can help unsighted players identify and stay oriented with the various critical locations.

Every fingerkey on the playing surface lying adjacent and behind a given fingerkey sounds a pitch 102 cents higher than the given fingerkey's pitch. And every fingerkey lying to the right of a given fingerkey sounds a pitch 600 cents higher than the pitch that the reference fingerkey sounds.

With the key signature group of FIG. 2 set for reference to C and F#, the zero degree fingerkeys (−1200, 0, 1200 cents) would sound C, and the sixth degree fingerkeys (−600, 600, 1800 cents) would sound the tritone F#.

Figure 3:
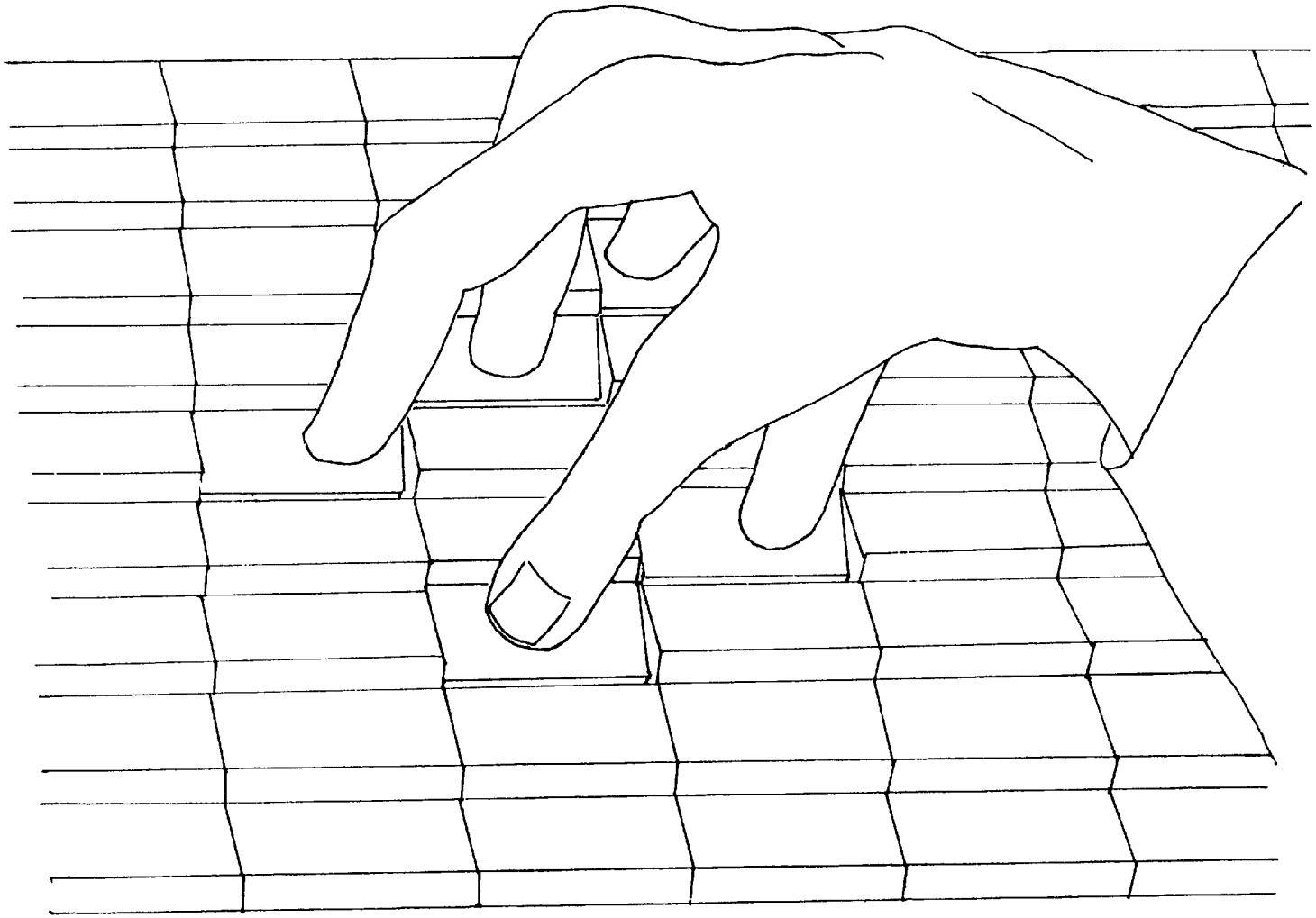

The hand in FIG. 3 is shown making a major triad chord with two other scale pitches. The five notes are the 0, 396, 702, 1098, and 1404. In the key of C, for example, these are the C, E, G, B, and D notes respectively. The pitches for this are shown circled in FIG. 4 using chromatic numbering.

This same chord can be made with this exact same hand formation anywhere on the keyboard where there are enough keys to allow this particular fingering and it will still be the same major triad. But to modulate this same chord (previously shown for the straight major scale) to another tonal center (but in this case) using another modal scale, the hand could finger the five notes as shown in FIG. 5. The root has been arbitrarily placed on the ninth degree tonal center, which in the key of C is an A pitch. Relative to the ninth degree now being the tonic, the five notes are −306, 102, 396, 804 and 1098. Using octave regulation by adding 306 to all of them (making the A pitch the new tonic), the intervals are revealed as 0, 408, 702, 1110, and 1404. Analysis will reveal that the five notes are the A, C#, E, G#, and B notes respectively. So it is indeed what is commonly termed an A major seventh with added ninth, but the intervals are not all the same as they were for the straight major scale. Thus the hand formation to make the same chord using this modal scale is different from the hand formation used to make the same chord utilizing the straight major collection of chromatic pitches. To the ears they will also sound different.

One of the great powers of this type of keyboard is that the other tonal centers always lie with the same compass orientation to the tonic. No matter the letter name of the key signature pitch, the player should always know where to go to find a specified modulation tonic to build a scale or chord around. A player that has memorized the location of the various tonal centers as oriented to the key tonic always finds this same data employed as a base of operations. All chord families retain their distinct fingerings.

For a keyboard, because it ideally supplies all the pitches necessary for a given tune all at once, any footshifting would be introduced with a simple pedal arrangement designed to retune the range of the instrument beyond the initial default values. The footpedal or switching means should have the power to uniformly shift the required tritone pair values with transparency. This means that when a finger key is depressed and sounding (prior to a footswitching action being triggered), if the particular tone sounded by that particular finger-key is commanded for a frequency change, this change will not be implemented until the finger-key is released and then depressed again. This prevents a chopping off of note values if a player is premature with a footshifting operation while retuning the instrument while playing.

Fretted String Instruments

The fretted string instruments are a group including such diverse members as guitars, bass guitars, banjos, mandolins, sitars, etc. The common feature is the use of strings that generate variable tones when the string is shortened or lengthened while being pressed against a series of usually metallic frets, and the string is excited or plucked.

In general, these instruments have the frets extended across the breadth of the neck of the instrument to allow the same long-fret to handle all the strings passing over it. Since 12 tone equal temperament is especially accommodating to a long-fret type of arrangement, this is the common practice. An instrument can be placed to follow a particular nonequal tuning by having each fret subdivided into six sections termed note-frets, each of the six wide enough to handle only one string. This disrupts the even length and placement of long-frets.

Figure 6:
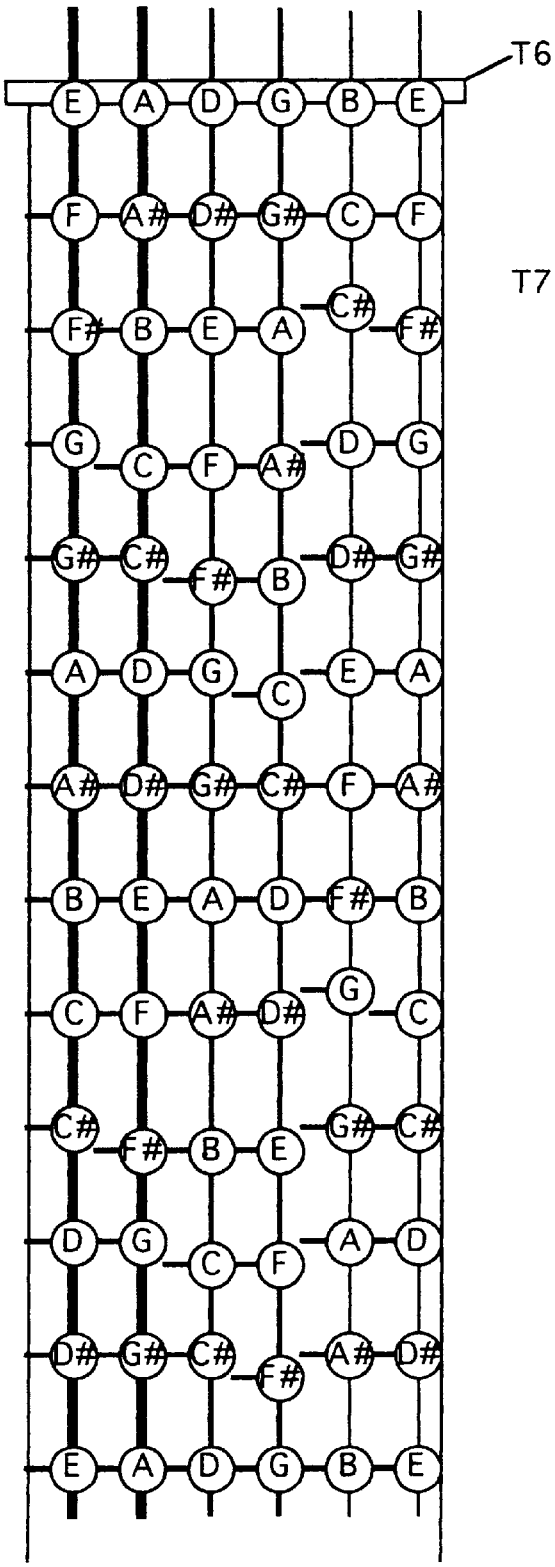
Figure 7:
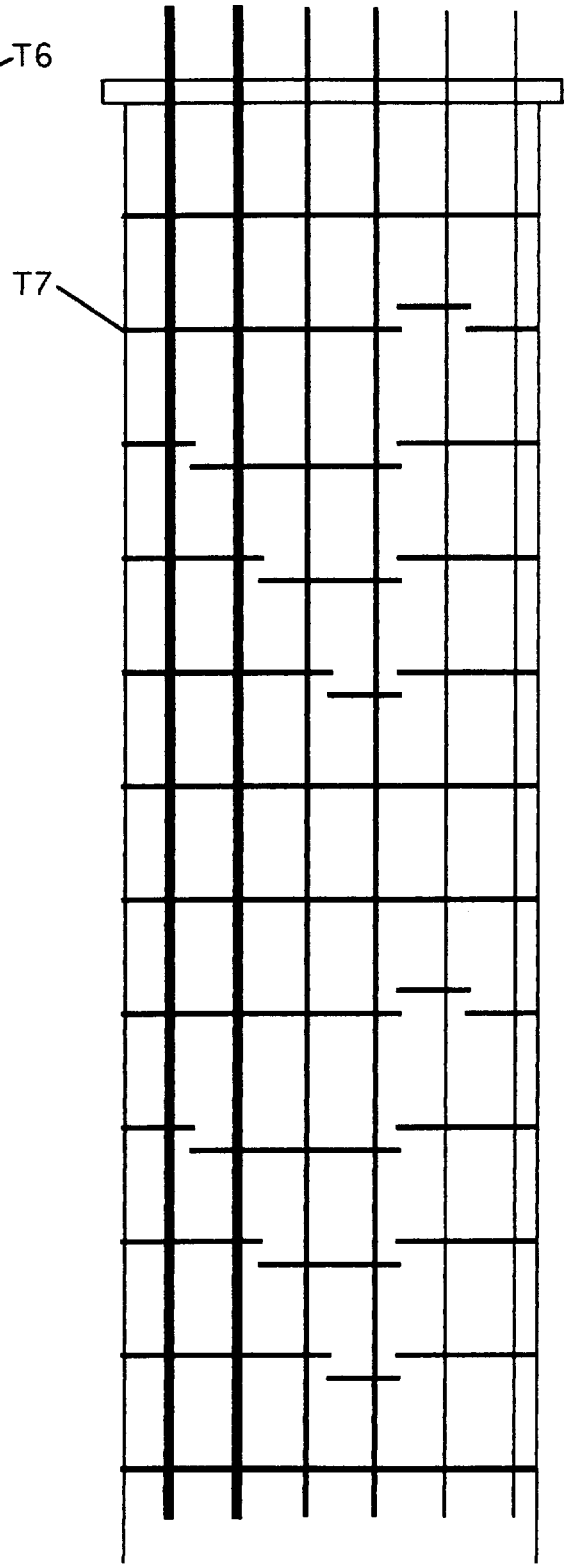

Taking as a representative member the common six string guitar, to establish a chromatic note-fret arrangement to play the tritone pair E and A# with the straight major scale of bicameral tuning, the initial note-fret setup is shown in FIGS. 6 or 7. As shown, this means a player can successfully play the entire straight major scale on E and A# as tonics. These two tonal centers are the tonic group.

Figure 8:
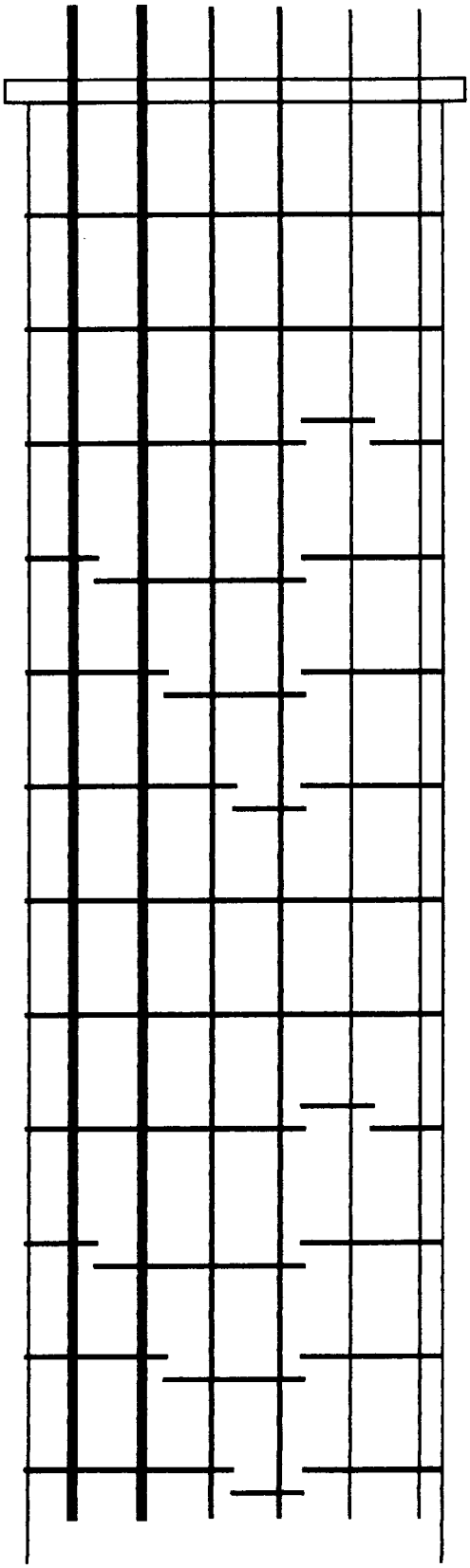

If all the individual note-frets for the notes C# and G either simultaneously move or are replaced in a sharp (shorter string length) direction, such that the new note-frets sound a tone 11.7 cents sharper than the initial pitches, then the instrument will now allow the player to correctly sound the 12 pitches of the straight major scale on F and B. These two tonal centers are the dominant group. The resulting note-fret layout for this modulation is shown in FIG. 8.

Figure 9:
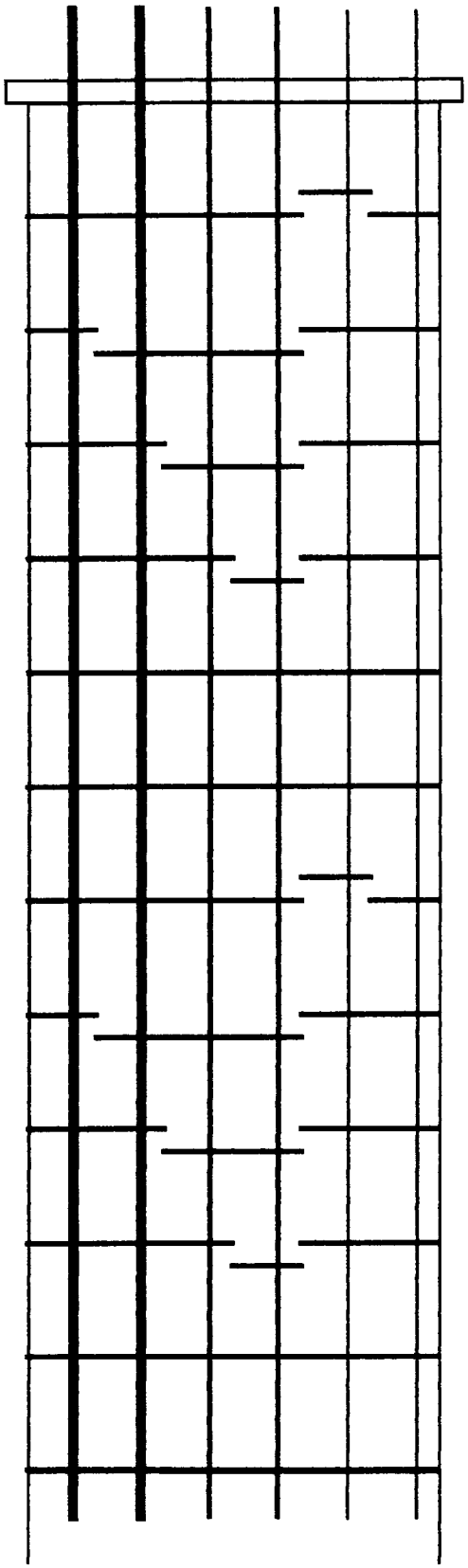

Returning to the neutral conditions of FIG. 7, if all the individual note-frets for the notes F# and C either simultaneously move or are replaced in a flat (longer string length) direction, such that the new note-frets sound a tone 11.7 cents flatter than the initial pitches, then the instrument will now allow the player to correctly sound the 12 pitches of the straight major scale on D# and A. These two tonal centers are the subdominant group. The resulting note-fret layout for this modulation is shown in FIG. 9.

A three switch selection array (such as foot-pedals) can be placed within the motor control of the player to instigate and retract these operations. A pedal mechanism to do this is shown above T37 of FIG. 13. A modulation to the subdominant group from the dominant group moves the two subdominant note-frets in a flat direction simultaneously with the dominant's two related note-frets returning (also with a flatting action) from the foreign position (or vice versa when moving to the dominant).

The minimum of 3 switches can be foot-operated, hand-operated by unused fingers of the plucking hand tapping a switch assembly fastened to the palm or (slightly ahead of and below) the bridge, or by other motorcontrolled operatives. The control itself can be a 3 directional joy-stick pushed in a certain direction, a discrete flat-panel trio of switches, etc.

The end effect is that the selected note-frets move in a way following the wishes of the operator. To give the instrument the capabilities to play effectively with another (a fourth) adjacent tritone pair, more tritone pairs of note-frets must be movable. This means the foot pedal arrangement must be expanded beyond (not shown) the basic 3 positions illustrated.

Figure 10:
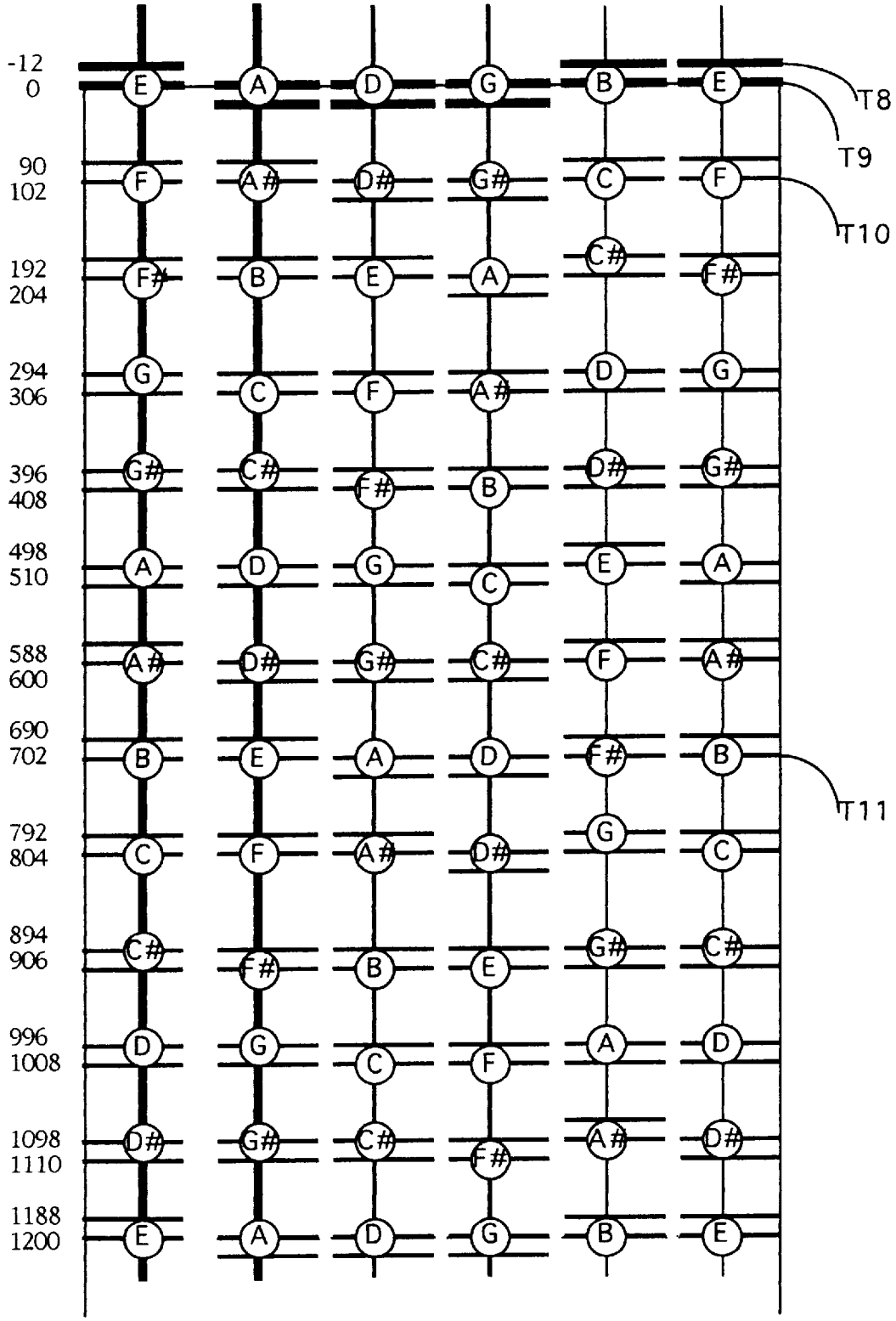

Since the guitar must ideally provide 24 tones overall, the range of positions necessary for a full scale empowered guitar is shown in the preferred embodiment of FIG. 10. A complete guitar neck is depicted (not to scale) from the nut up to the 12th note-fret position. A bass guitar of common configuration would only use the lower pitched four strings.

Figure 12:
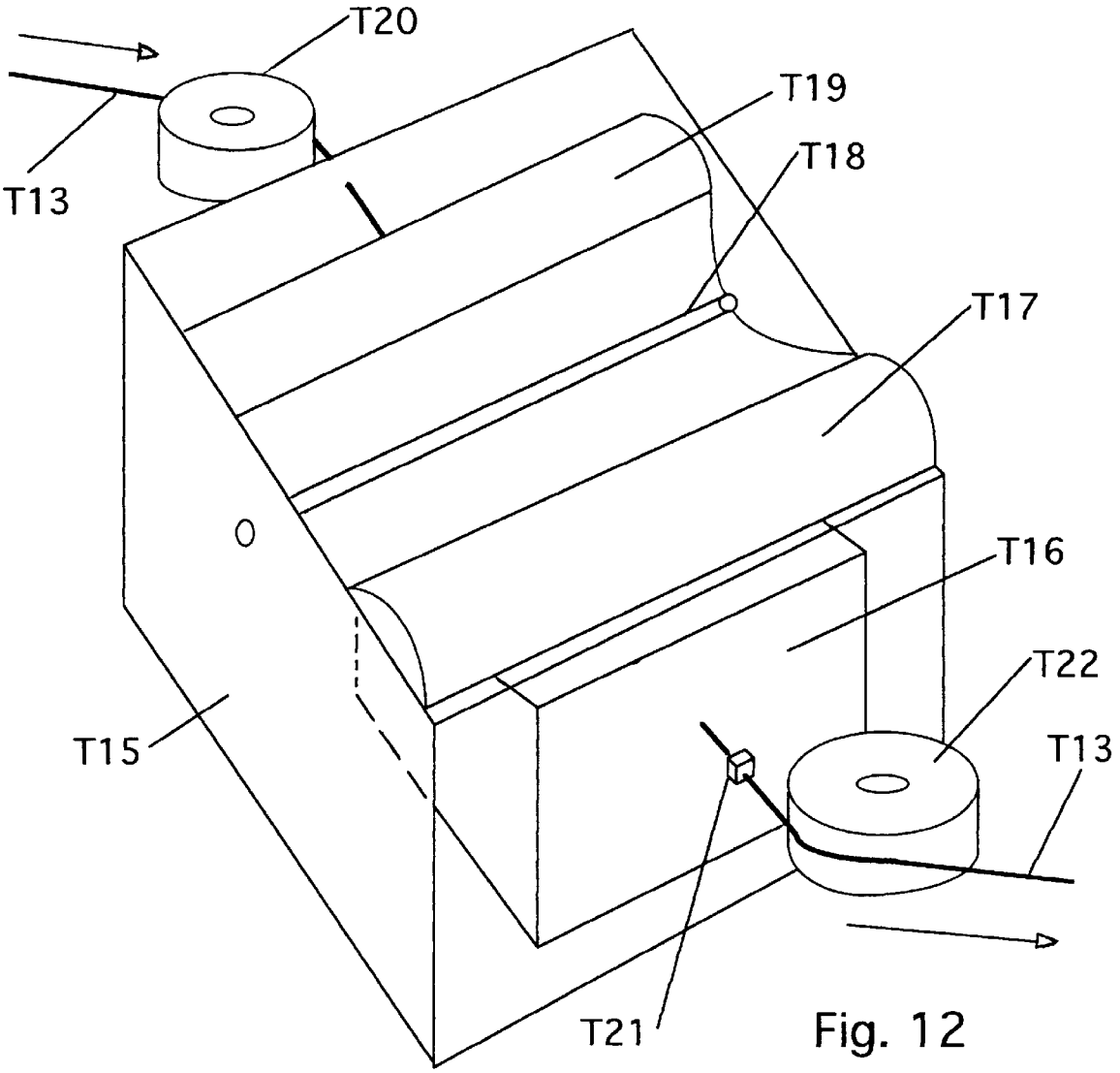

All the notes, via the note-frets, must have the capabilities to be either sharped or to be flatted from the tonic position. With these capabilities, the full complement of 24 notes are available, but not all at once. This particular instrument will have the most modulating flexibility in the key signature E and A#. In the same fashion, a guitar could have the fret-boxes of FIG. 12 positioned in the neck in such a way to empower the optimum tonal centers to be another tritone pair, as for example C and F#.

A guitarist deciding on a key signature can with one tap send a selection code into an on-board processor to initially set up the frets for any tritone pair whose full scale needs fall within the compass of the instrument. When the guitar is set up for a particular pair as the key signature source, the player chords and scales the instrument as with 12 tone. A one stroke tap of the pedals is all that is necessary to instigate modulation changes.

The pedals signal the processor to move the correct enharmonic pitches in and out of play as directed by the player. Many times a guitarist may access a component tonal center of either group and have no need at all to move the two associated note-frets for foreign pitches. Moving the note-frets wouldn't bother anything in these cases, but would be wasted motion.

Additional switch action can be configured to trigger the processor to enable the tonal centers for specialized modulations. (Alternately two of the plurality of switch-pedals can be depressed together for combinational effects.) For instance, a convenient switch could be dedicated to flip certain tonal centers from playing straight major to next play a different modal scale, or vice versa. Another flip would restore the instrument back to the original setup. Complete flexibility to do these flips might require more than 24 pitches in the full scale, as this increases the number of tonal centers specified to hold the full scales. A possibly overambitious scheme to have three-way note-frets at up to all twelve possible pitch locations is conceivable for these increased capabilities. Other tracking features along these lines can be linked to the processor, to allow certain fret setups or specified key modulations to be switched into play at literally anytime.

The note-frets themselves can be collectively controlled by various electromechanical assemblies such as wires and pulleys or levers under the control of processors. This would allow the various six tritone pair note-frets to move in unison when individual pairs must be changed.

Figure 13:
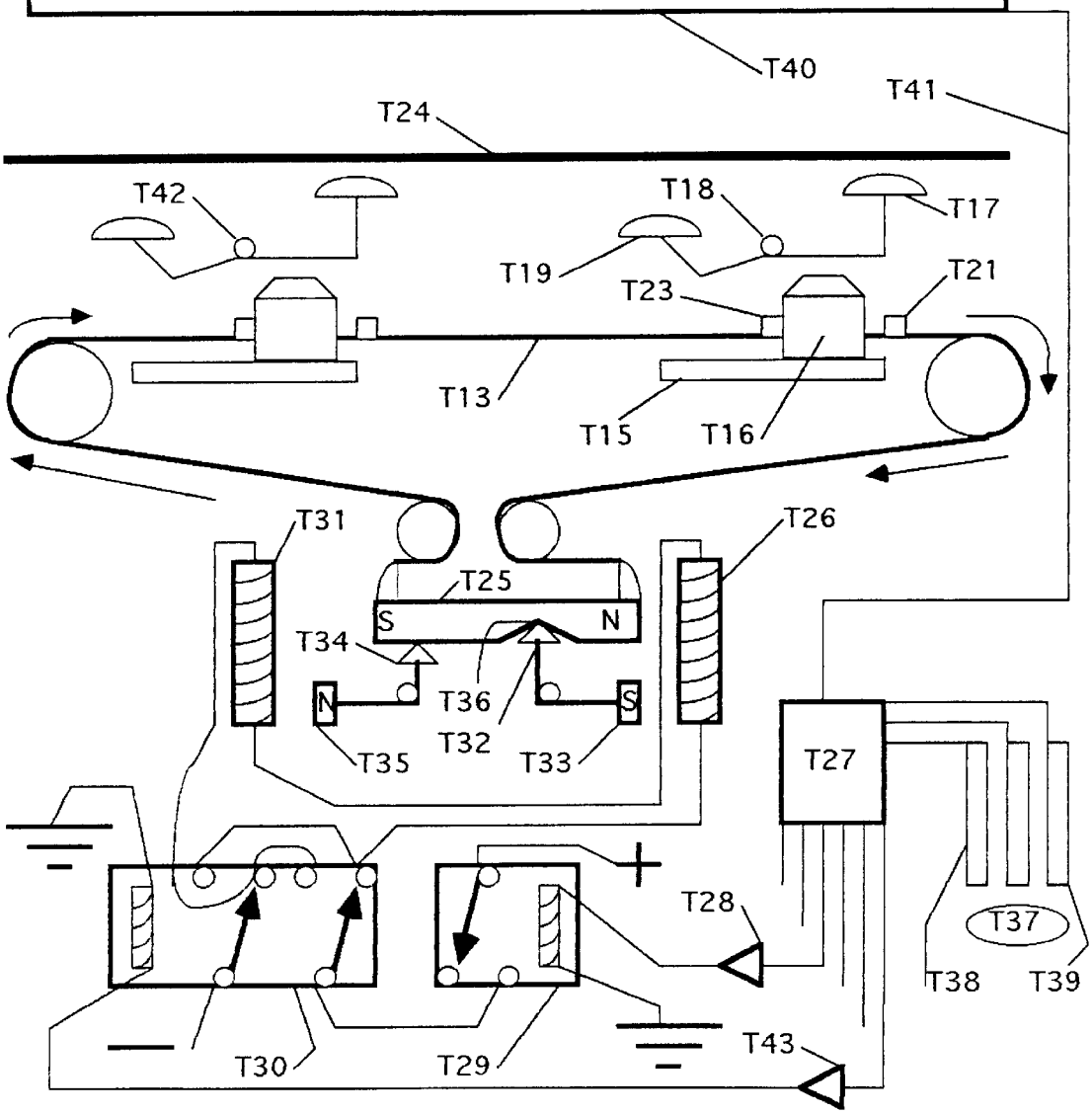
Figure 14:
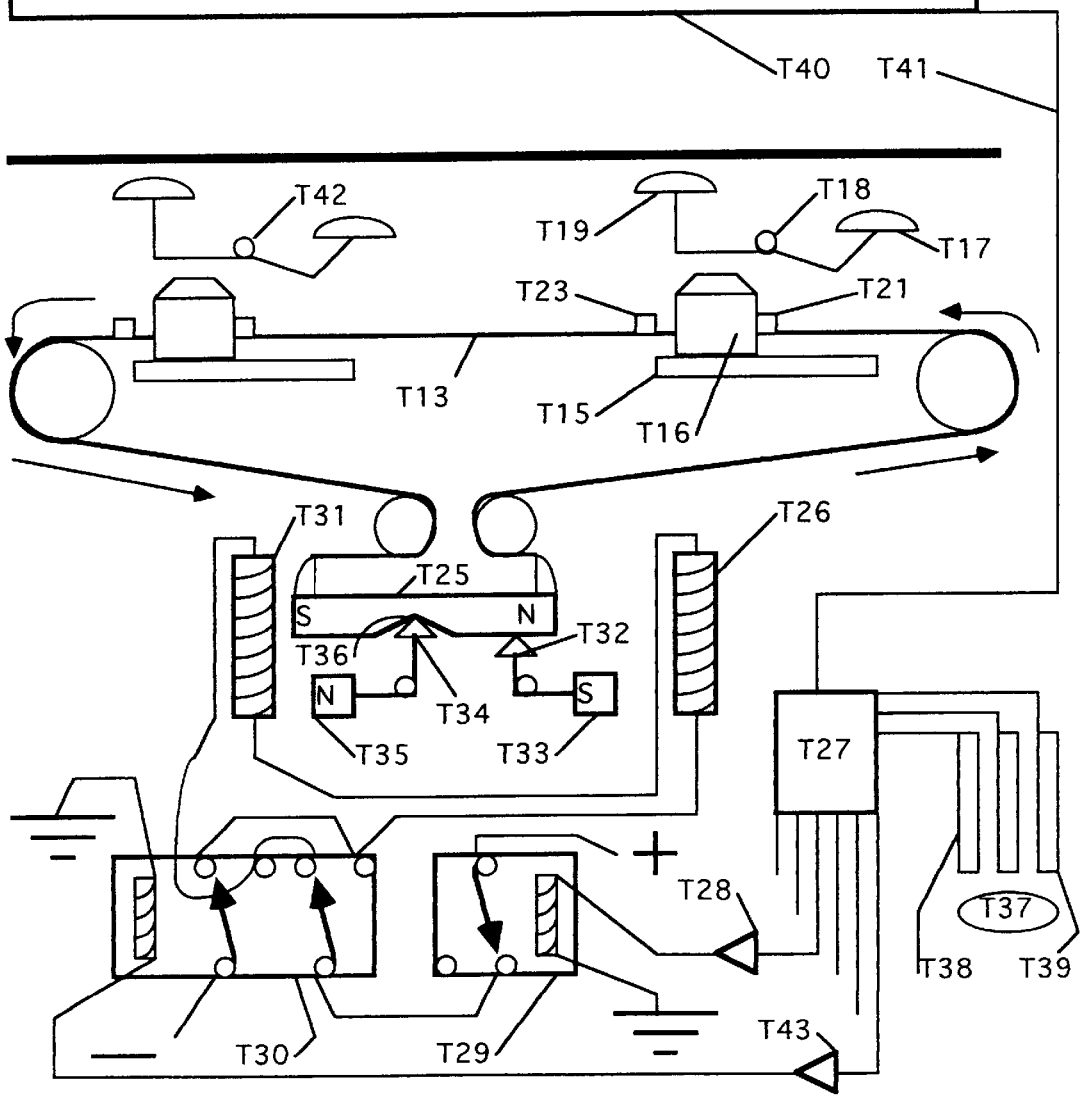
Figure 17:
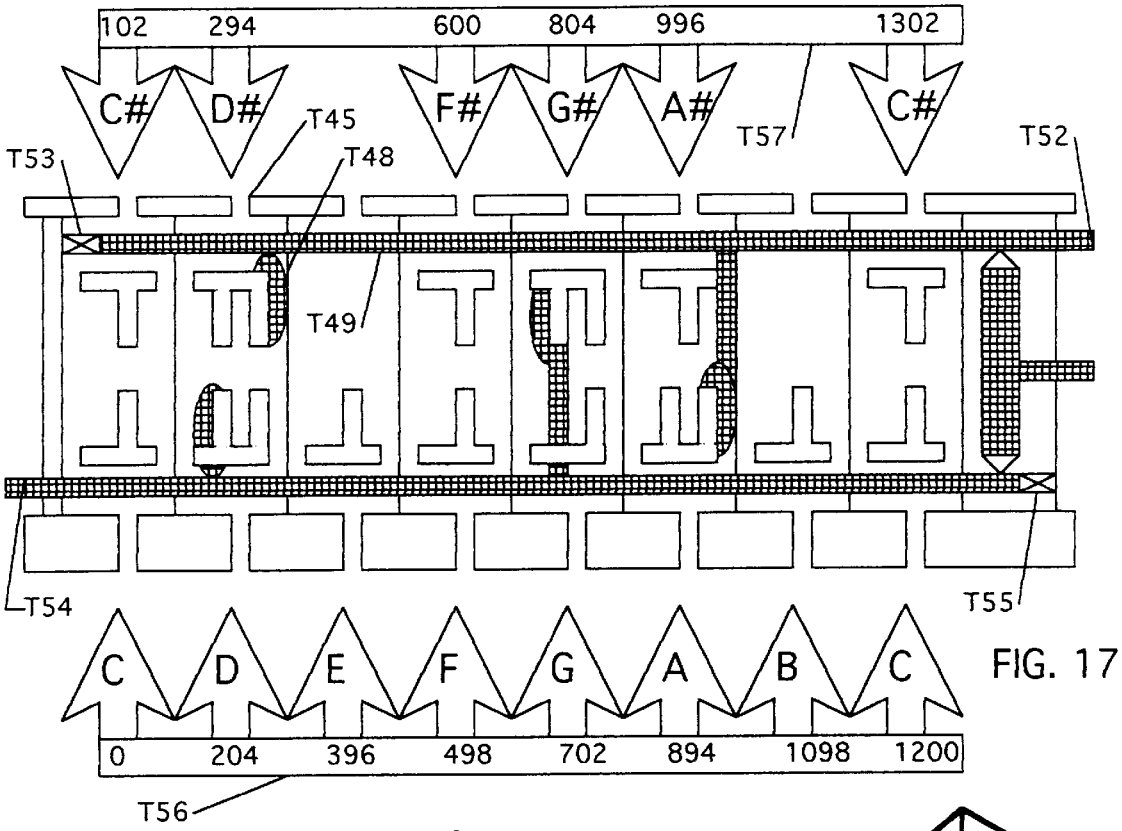
Figure 16:
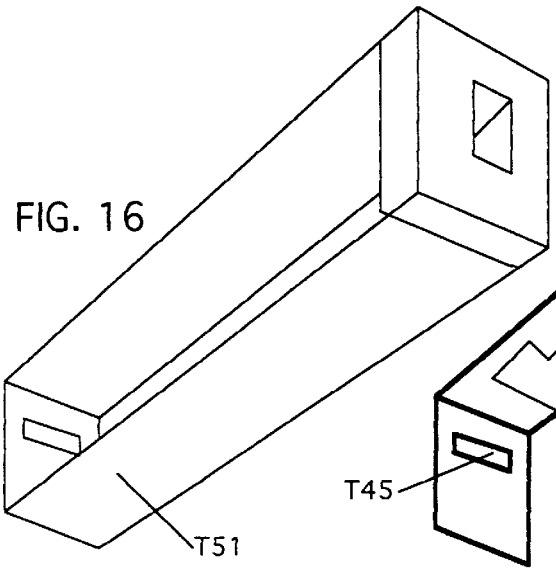

A method that see-saws the various note-frets back and forth is shown in FIGS. 13 and 14. It should be noted that as the neck is traversed towards the strumming hand, the distance between the tandem note-frets shortens, as well as the distance between the fret-boxs holding each tandem pair. Therefore, each apparatus will need graduating to allow for this. Methods can be employed other than the see-saw action of the design depicted.

Magnetic fields under processor control are used to collectively alter the note-fret locations. By switching on an electric field via a relay through a coil of wire in a certain direction to generate for example a south polarity, a magnetized mule with a permanent north orientation on one end can be drawn to the coil. The mule is attached to the pulley lines, and it see-saws all the connected note-frets via a shuttle effect. A catch locks the mule into the new position and turns off the relay.

Whenever the processor opens a double-pole relay together with the off/on relay, a different polarity (in this case north) is expressed by the coil. The north polarity coil attracts a portion of the lock previously impaling the mule, which disengages it. The north end of the magnetized mule is then thrust back away from the similar north magnetic coil. At the other end of the mule, its other end carries a south polarity and is drawn to the other north expressing coil. The mule is thus both pushed and pulled.

The mule control region is shielded, especially if it is inside the body of the guitar. This prevents stray magnetic fields from interfering with the activity of nonrelated transducers under the strings of electric instruments. Other methods using nonmagnetic methods to move the frets and/or mules can be employed, such as pneumatic, hydraulic, or localized solenoids, etc.

A nonelectric instrument could be built with the pulley loops moved back and forth strictly by human-powered levered action. Sliding controls built into a position beneath the strings and ahead of the bridge would allow a player (who uses a pick) to utilize unused fingers to activate these levers.

Figure 11:
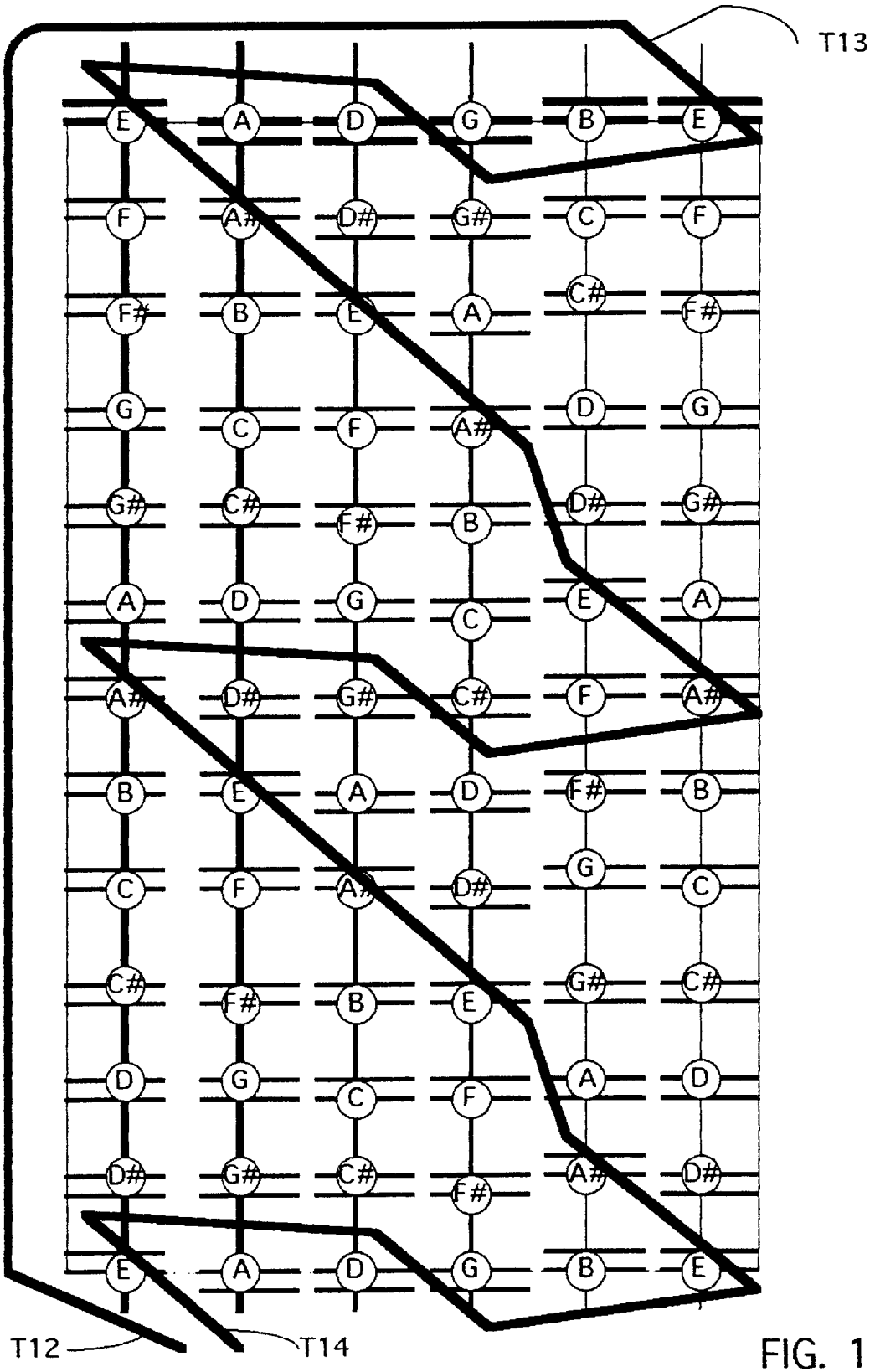

Advantage can be taken of the physical arrangement on the neck of a paired family of a given tritone pair. Using FIG. 11 as a reference, a connected line can be drawn from the low E of the nut, to the A# of the first fretline, to the E of the second fretline, and to the A# of the third fretline. By skipping the fourth fretline, continuing on with the E of the fifth fretline, the high and the low A# of the sixth fretline and so forth; the underlying note-frets all controlling E and A# pitches can be ganged together and thus be sharped or flatted in unison.

Guitars with special fretting schemes to achieve certain favored "open" tunings would also be a practical application. The note-fret arrangement of FIG. 10 was depicted for guitarists who use the standard E, A, D, G, B, E open string tuning. A fretted string instrument providing what is termed a "dropped D" tuning (the lowest E string is tuned down to a D pitch) would require a different note-fret layout for the lowest string. As a result, the initial 2-way fret-box placement for that string would have to be engineered to the requirements; or if the instrument is to keep its ability to also to have the low string tuned to E, a pair of note-frets along that string would have to be given three-way capabilities. Other similar nontraditional arrangements of the open strings would require dedicated modifications.

Wind Instruments

In general, contained reed instruments produce sounds as a result of air being blown or forced into and through an enclosed region. A simple wind instrument, such as a harmonica, supplies a number of holes that air is either blown into or (in a reversed process) withdrawn from. Enough holes are generally provided to play a seven member scale in this fashion. Chromatic versions provide a small insertable button that is pushed in by a finger at desirable times to collectively (all at once) sharp (or flat) the required notes. In this way a full 12 member chromatic scale is provided.

A similar trio of buttons could be alternately added to sharp, flat, or neutralize (by steps of 11.7 cents) an instrument providing a bicameral scale. These three performance buttons would be used to move any individual pitches when a song modulated (in a simple embodiment) among the tonic, dominant, or subdominant modulation groups. Any time one of the three keyed levers had been previously placed in the engage position, pushing in another of the trio would snap the other out of its locked "on" position. These latter keyed modulation levers would convert only the scale members requiring a shift to the enharmonic values.

Figure 15:
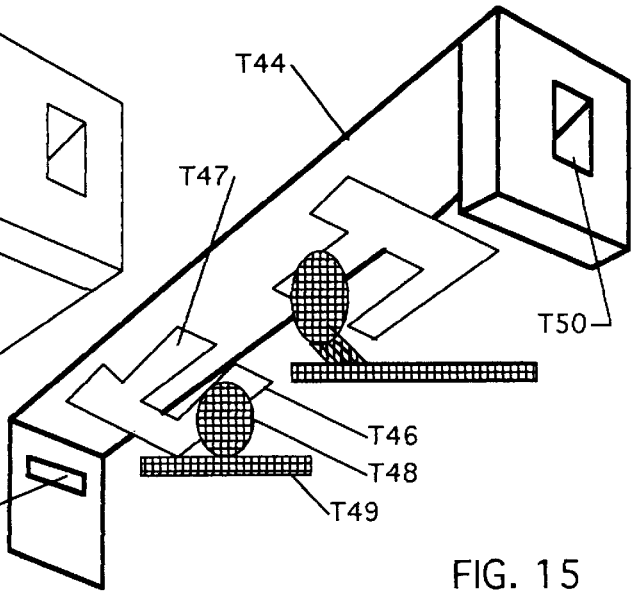
Figure 18:
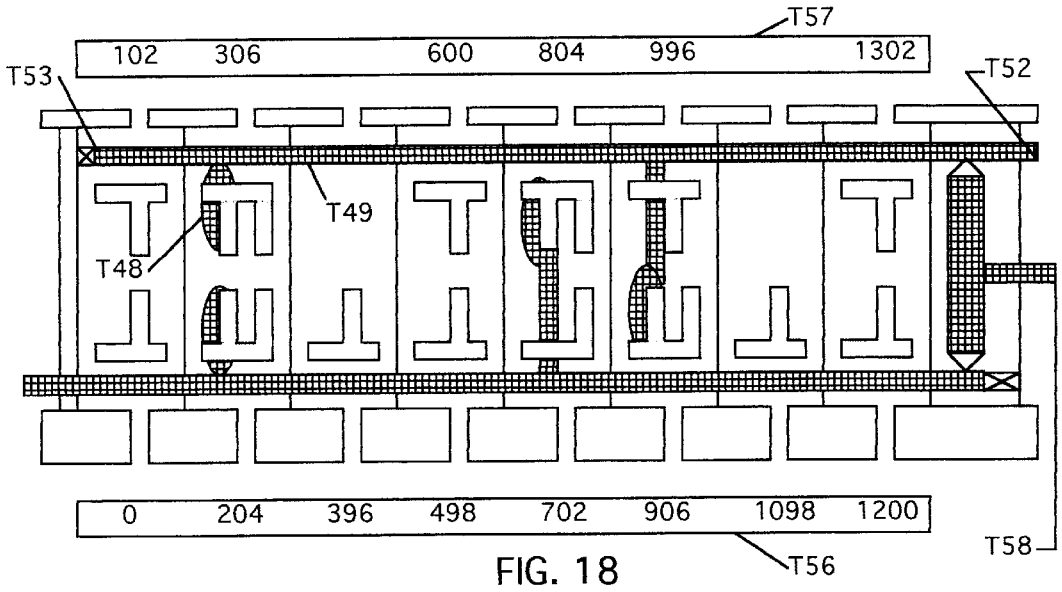
Figure 19:
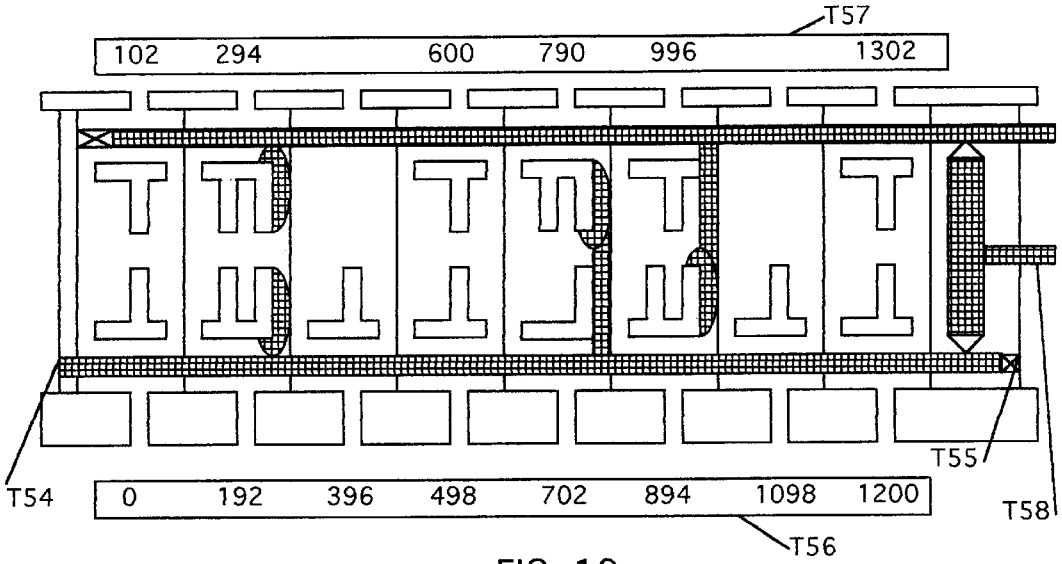
Figure 25:
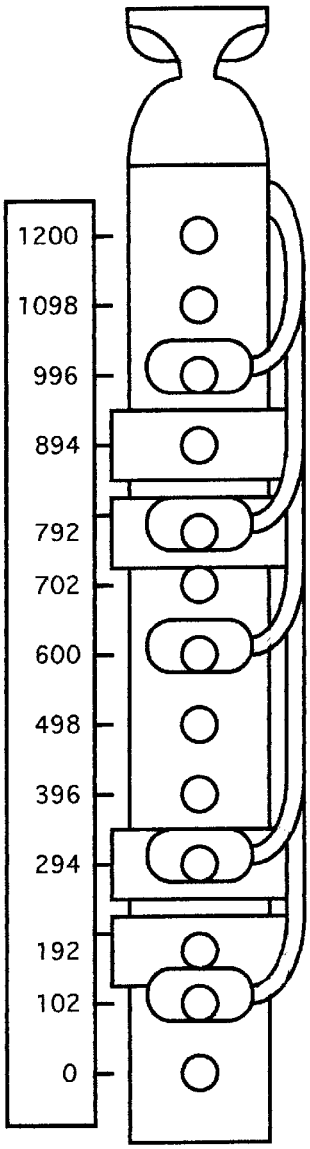
FIG. 25 shows a frontal view of the same instrument after enabling of the subdominant foreign pitches, and lists the current chromatic values. The related movable segments are physically moved to the flat position generating foreign values of 792 and 192.

Since harmonicas operate on the principle of metallic reeds of specified length vibrating in an airflow of specified direction, a simple method would have a dampening nodule to be shifted between two alternate reed values on demand by the locking key. Only one of the two would be sounded at any one time, and they would be tuned with an 11.7 cent difference in pitch. This is shown in close-up in FIG. 15. Once again, the musician must have the sophistication to know when to introduce the enharmonic notes. The division of the modulating tonal centers into three groups is not a hard initial concept to master, and these relationships are soon memorized.

Column of air wind instruments, such as the flute and piccolo group that use fingers as stops, produce their tones as a result of escape holes (termed tone holes) that allow the air to rush out of the instrument at the shortest open hole nearest the mouthpiece. These tone holes are calibrated to allow certain pitches of a certain scale to sound at stepped locations, which can be manufactured as bicameral scale positions to the extent needed. The octave range is limited if holes are stopped solely with fingers.

To achieve the bicameral scale on more complicated column of air designs that employ mechanical capped stops, the instrument can have the airflow moving along longer or shorter pathways to accommodate different modulation requirements. The barrel holding the tone hole slides to the required position under key-levered control. A disadvantage is that the fingers must move to a slightly different location (corresponding to the move) to stop the tone hole. However, an 11.7 cent move is not very far, and the altered location should not be unexpected to the player. This is shown for a generalized column of air instrument in FIG. 26. The tone hole T62 for the 306 cent value is closer to the top than the 294 cent value of FIG. 24.

Another fine tuning method is shown in FIG. 27. This method uses various movable interior masks (with a hole in the center) that slide a short distance along the interior barrel, altering the interior position (and/or shape) of the tone hole openings. This effectively retunes the associated opening to a pitch 11.7 cents further (flatting) from the mouthpiece, or closer to the mouthpiece (sharping). This is suited to wind instruments (such as saxophones) that require a fixed location of the tone holes, which is due to the need for bulky chromatic mechanisms (rather than fingers) to cap (stop) the tone holes. Interior masks are also less subject to wear.

Horns are another type of wind instrument. A specified tube length is lengthened by the introduction of one or more loops of tubing to drop the sounding pitch by a specific interval distance. As a few examples, tubas, trumpets, and French horns typically work with various valves to produce differing pitches from a sounding tone. With an equal temperament horn, the minimum three valves used to drop the pitch by a semitone, a tone, and a tone and a half are usually tuned to provide the exact required values. For instance, a tone and a half subtracted from a standing octave harmonic of the tonic would yield the diatonic major sixth directly below the sounding tone. The use of a dedicated valve is done to accommodate acoustical law, since the small combination of the first and second valves does not provide enough overall length to yield the correct desired 300 cent tone and a half.

However, with a bicameral scale the semi-tone value is set to 102 cents and the tone value set to 204 cents. In combination they drop the tone and a half to 294 cents, which is a correct value in the bicameral scale. Thus the third valve is dedicated to drop the pitch by 396 cents, which is two tones.

Further dedicated valve action to provide three other values for other required foreign pitches is necessary to allow the instrument to furnish up to (or beyond) the 16 pitches required for basic dominant and subdominant modulations. Such a French horn is shown in FIG. 28, where six rotor valves displayed left to right from T77 to T81 have values 39.8 cents, 20.7 cents, 396 cents, 204 cents, 102 cents, and 11.7 cents. For further identification, these six valves are termed below as V40, V20, V396, V204, V102, and V12.

The three smallest, when combined with one or more of the three largest, effectively drop the combined value by their own labeled value. But used alone, none of these three drop the sounding tone by their labeled value. Also, the V40 and V20 valves could be replaced with compensating loops that introduce the required value automatically rather than by dedicated valves.

To play a horn, the operator blows two degrees of the overtone series (tonic multiples or perfect fifths), which allows a compass of usually three octaves. All other steps are achieved with valve action. If the highest fundamental overtone is blown, it can be dropped in four sequential half step stages with valves; then a perfect fifth can be blown without valves depressed, and then lowered in six more sequential half steps with valves; and finally a tonic overtone one octave below the initial pitch can be blown to reinitiate the same fingering process for the next lower octave.

A fingering chart would thus read: 1200 cents=open, 1098 cents=V102, 996 cents=V204, (906 cents=V102+V204, enharmonic 894 cents=V102 +V204+V12), (804 cents=V396, enharmonic 792 cents=V396+V12), 702 cents=open, 600 cents=V102, 498 cents=V204, (408 cents=V102+V204, enharmonic 396 cents=V102+V204+V12), (306 cents=V396, enharmonic 294 cents=V396+V12), (204 cents=V102+V396+V20, enharmonic 192 cents=V102+V396+V20+V12), 102 cents=V204+V396+V40, 0 cents=open. The listed enharmonic values allow user choice for the 16 pitches theoretically required for a typical three chord song. Value 408 is an extra bonus pitch which extends the modulation power of the horn sufficient to allow a major second on the 204 cent pitch as tonic. The combined values are correct to a tolerance of much less than one cent, with the exception of value 192 which will sound slightly sharp (one cent) to theory. The V12 value (almost 15 cents by itself) was not calibrated for this particular combination, and would in fact need a tiny bit more length.

Variations to the Preferred Embodiment

Some wind instruments are so finger intensive, or bound up in tradition, that a processor-controlled pedal affair (for the foot to control by tapping) may prove more feasible than finger activated means. Electromechanical levers could be employed to relocate the various tone holes, effect valves and masks, or lengthen sections of tubing. However, electrifying what is usually an acoustical instrument should be more of a last resort and is not recommended, but it can indeed be done. A see-saw action closing one hole while opening another would be a feasible alternative to sliding a segment.

The shifting itself, as detailed for the horns, would introduce and remove the various enharmonic foreign notes in the desired fashion with a small inconvenience. Once again, the musician must observe the individual requirements of the tonic, dominant, and subdominant groups.

As another alternative of a different nature, some instruments could be predesigned as a multitone instrument, with adjacent enharmonic stops to allow an extra four enharmonic pitches per octave to be always available. These additional stops would require new fingering techniques where one finger might close two stops. For high pitches, the fingers must be able to select between enharmonic notes very close together on the barrel. A wind instrument configured in this manner would be a variety only useful in a limited number of key signatures, since the length of the column of air itself could set the spacing too far for comfort between certain enharmonic toneholes. However, it would put aside the need for shifting pitch values.

The multitone keyboard as described (but with linking intervals of 700 cents) is suitable to produce the prior art 12 tone; and with linking intervals of 705.9 cents is suitable for 34 tone equal temperament. Many other tunings will be possible to advantage on this instrument. Although a linear coordination of the keys is recommended (with the columns of keys lined up with perfect vertical alignment as illustrated), a staggered (off-center) coordination of the keys is possible. As such, each ascending tier should be offset by the same amount from tier to tier for consistency.

For bicameral tuning, by changing the reference tritone rung value from the preferred 600 cent interval (while keeping the same linking interval for both tone-strings constant), a disruption in modulation symmetry occurs for the tritone pairs. The straight major scale employed on the tonic pitch will be different from the provided cent values for this same scale as when employed on the tritone pitch. For example, by lowering the 600 cent rung value, the major third for a chromatic scale relative to the tonic is also lowered. Relative to just intonation, this can be considered an auditory improvement. But this will cause a counter sharping of the major third as measured from the tritone's perspective, which is not an auditory plus.

The opposite happens if the 600 cent rung value is increased relative to the tonic; the straight major third will improve (flatten) for the tritone used as a tonic, but worsen (sharp) relative to the tonic.

The loss of a 600 cent tritone rung value thus has mixed results; the operator alters a chosen tone-string's cent values more towards the ideals of just intonation, but loses the simpler modulation schemes provided when either the tonic or tritone can host the defined scale with isomorphism.

Another variation is that the defined scale can be non-sesatonic, with the disadvantage that this would increase the number of modal scales beyond six. To prevent alteration of the chosen scale, a modulation to the chromatic seventh (the dominant) would still require each of the two tone-string to individually have a foreign pitch introduced from the other bicameral tone-string. In the same way, an isomorphic modulation in bicameral fashion from the tonic to the chromatic fifth (the subdominant) would also still require the obligatory shifting of two pitches.

If an instrument has the ability to simultaneously provide seven tritone pairs, such as an enharmonic keyboard, then this non-sesatonic scale would be less trouble for modulations than systems for chromatic instruments. This means that a defined scale would not be chromatic (12 member), but would be enharmonic (in this case 14 member) in order to allow isomorphism on both the tonic and tritone.

These initial 14 members of the defined scale would require two additional values to enable the dominant group and two additional values to enable the subdominant group. This adds up to a total of 14+2+2=18 values. The keyboard of FIG. 2 provides 18 values per octave, and thus has the capabilities to handle this type of note requirements for three chord songs based on an enharmonic defined scale. However, this situation would not be so easily adapted to a usually chromatic instrument such as a guitar.

Conclusion

Various instruments known as free pitch instruments have the ability in theory to sound all pitches lying between the limits of a particular interval. A good example is a violin. These prior art free pitch instruments are not a primary concern of this paper if they are not specifically and physically modified to assist a player to perform a valid scale of bicameral intonation. This modification would then classify them as stepped pitch musical instruments. Instruments that provide their pitches in quantized steps, and are produced with the ability to play a valid bicameral scale, are termed stepped pitch instruments and are the primary objects of this invention.

The bicameral tuning system lends itself to numerous adaptations, and therefore to a variety of instruments to play these adaptations. As described, the 16 member tonal scale shown as a typical embodiment can be expanded beyond 16 or shortened to less members.

A bicameral harmonica would typically only express a diatonic scale whose initial seven pitches would be a subset of a reference defined chromatic scale. The instrument would contain the latent ability to furnish many more pitches from the reference scale than an initial seven per octave. In this case it is not so much the quantity of pitches offered, but rather the distinctive alteration or replacement of prescribed scale components to preserve isomorphism that is one of the distinguishing features of the bicameral process.

Lastly, the ultimate end product of a tuning system is the music itself. Any music performed utilizing the bicameral tritone pair system, whether sounded with prior art free pitch instruments or those crafted to the invention, falls under the concern of this paper if it is performed for profit, or if it is broadcast or contained by fixed medium.

This invention should not be confined to the embodiments described, as many modifications are possible to one skilled in the art. This paper is intended to cover any variations, uses, or adaptations of the invention following the general principles as described and including such departures that come within common practice for this art and fall within the bounds of the claims appended herein.

I claim:

1. In combination,

A) a stepped-pitch musical instrument;

B) a plurality of sound selection devices controlling a minimum of twelve elements, said devices subject to operator selection, said elements sufficient to provide a defined chromatic scale of pitches containing twelve pitch stations;

C) wave propagating means responsive to activation of said elements, said wave propagating means enabling the production of sound waves of distinct frequency corresponding to said selection of said selected devices;

D) said devices further arranged such that said defined chromatic scale contains both a first and a second tone-string of said sound waves, such that said first tone-string contains the tonic pitch of said defined chromatic scale, and such that said second tone-string contains the tritone pitch of said defined chromatic scale, whereas said tonic pitch and said tritone pitch of said defined chromatic scale are together termed the tonic pair;

E) said devices further arranged such that the particular pitches of each of said first and second tone-strings are not shared in common and such that both of said first and said second tone-strings each have a precise minimum of four similar intervals linking five of said particular pitches in ascending succession, where similar is defined as identical within a specified tolerance, where said specified tolerance is a cent value no greater than 1.5 cents;

F) said devices further arranged such that said first and said second tone-strings together contain six rung intervals separating six tritone pairs, whereby the value of a particular rung interval is the same rung interval within said specified tolerance for a basic minimum of five of said six tritone pairs;

G) said devices further arranged such that an actual minimum of ten of said twelve pitch stations of said defined chromatic scale are isomorphic within said specified tolerance relative to either of said pitches of said tonic pair when either is used as the zero degree station for said chromatic scale, and where the remaining five tritone pairs not including said tonic pair are categorized as modulating pairs;

H) said devices further arranged such that the values of a majority of the semitone intervals of said defined chromatic scale do not equal or do not approximate within a precise tolerance of 0.5 cents a 100.0 cent semitone interval.

2. The musical instrument in claim 1,

A) said devices further arranged such that said precise minimum of similar intervals is five, and such that the number of said particular pitches in ascending succession is six;

B) said devices further arranged such that said basic minimum of said six tritone pairs is six;

C) said devices further arranged such that said actual minimum of pitch stations of said defined chromatic scale expressing isomorphism is twelve.

3. The musical instrument in claim 2,

A) said devices further arranged such that the value of said five similar intervals linking six of said particular elements is a Pythagorean fifth, having a value that is 702 cents, within said specified tolerance;

B) said devices further arranged such that the value of said particular rung interval is 600 cents, within a rough tolerance of no greater than 13.5 cents.

4. The musical instrument in claim 3,

A) said devices further arranged such that said rough tolerance is either a value on or between 1.1 cents through 9.0 cents or is a value on or between 0.0 cents through 1.0 cent.

5. The musical instrument in claim 2,

A) with additional sound selection devices arranged to control a finite minimum of two enharmonic elements such that said defined chromatic scale is further isomorphic within said specified tolerance relative to either pitch of one particular pair of said five modulating pairs of said defined chromatic scale, and such that said two enharmonic elements produce on command two foreign pitches enharmonic for two original pitches of said defined chromatic scale, where said two original pitches are superfluous pitches of said defined chromatic scale;

B) said additional sound selection devices further arranged such that the specific shift musical interval separating said foreign pitches from said superfluous pitches is either a value on or between 19.8 cents through 27.0 cents or is a value on or between 8.0 cents through 19.7 cents.

6. The musical instrument in claim 2,

A) together with operator-controlled recursive switching means;

B) said sound selection devices further configured such that operator activation of said switching means replaces a plurality of superfluous pitches expressed by said minimum of 12 elements with enharmonic pitch values termed foreign pitches, where said superfluous pitches are component frequencies of at minimum one particular pair of said five modulating pairs of said defined chromatic scale;

C) said sound selection devices further configured such that subsequent actuation of said recursive switching means by said operator replaces the expressed frequencies of said foreign pitches with the initial frequencies of said superfluous pitches;

D) said sound selection devices further arranged such that the specific shift musical interval separating said foreign pitches from said superfluous pitches is either a value on or between 19.8 cents through 27.0 cents or is a value on or between 8.0 cents through 19.7 cents.

7. The musical instrument in any one of claims 5 or 6,

A) all said sound selection devices further arranged such that said one particular pair of said five modulating pairs is the individual tritone pair containing the chromatic seventh degree interval of said defined chromatic scale, said individual tritone pair is the dominant pair;

B) all said sound selection devices further arranged such that said foreign pitches are a higher frequency sharper relative to said superfluous pitches;

C) all said sound selection devices further arranged such that said defined chromatic scale is isomorphic within said specified tolerance relative to either pitch of said dominant pair serving as the modulated chromatic zero degree station of said defined chromatic scale.

8. The musical instrument in any one of claims 5 or 6,

A) all said sound selection devices further arranged such that said one particular pair of said five modulating pairs is the unique tritone pair containing the chromatic fifth degree interval of said defined chromatic scale, said unique tritone pair is the subdominant pair;

B) all said sound selection devices further arranged such that said foreign pitches are a lower frequency flatter relative to said superfluous pitches;

C) all said sound selection devices further arranged such that said defined chromatic scale is isomorphic within said specified tolerance relative to either pitch of said subdominant pair serving as the modulated chromatic zero degree station of said defined chromatic scale.

9. The musical instrument in claim 6,

A) said instrument belongs to the class of fretted string instruments, whereby the pitches sounded by said instruments are determined by a minimum of one selected string being pressed against one of a plurality of note-frets;

B) said operator-controlled recursive switching means are specific fret-placement controlling means, whereby the primary activation by said operator of said specific fret-placement controlling means exchanges said superfluous pitches available to said fretted string instrument with said foreign pitches, said exchange expediated by the simultaneous submerging of the particular note-frets enabling said superfluous pitches in favor of the elevation on command of different enharmonic note-frets enabling said foreign pitches at different prescribed locations beneath said selected string.

10. The musical instrument in claim 6,

A) said instrument belongs to the class of column of air instruments, whereby said column of air instruments sound designated pitches determined by the length of a section of tubing, said length separating a source of forced air and a release opening by a prescribed distance;

B) said operator controlled recursive switching means are lever-activated specific tube-length controlling means, whereby the activation by said operator of said specific tube-length controlling means changes said superfluous pitches of said column of air instrument into said foreign pitches as soon as said activation repositions said release opening to a different prescribed distance from said source of forced air.

11. The musical instrument in claim 6,

A) said instrument belongs to the class of column of air instruments, whereby said column of air instruments sound designated pitches determined by the length of a section of tubing, said length separating a source of forced air and a single release opening by a prescribed distance;

B) said operator controlled recursive switching means are valve-activated specific tube-length controlling means, whereby the activation by said operator of said specific tube-length controlling means changes said superfluous pitches of said column of air instrument into said foreign pitches by altering the distance of travel within said section of tubing from said source to said single release opening by a prescribed distance.

12. The musical instrument in claim 11,

A) together with a minimum of four of said specific tube-length controlling means individually introducing four insert tubes, the largest three of said four insert tubes lowering the sounding tone of said instrument under individual selection by 102 cents, by 204 cents, and by 396 cents all within said specified tolerance;

B) with the fourth of said specific tube-length controlling means configured to lower the combinational sounding tone of said instrument by an additional 11.7 cents when activated together with said 102 cent tube and said 204 cent tube;

C) said tube-length controlling means further configured such that said lowered combinational sounding tone is within said prescribed tolerance.

13. The musical instrument in claim 12,

A) together with a minimum of two extra tube-length controlling means individually introducing two calibrated tubes, each of said extra controlling means lowering the monophonic sounding tone by a prescribed frequency when in combination with other of said specific tube-length controlling means;

B) the first of said extra tube-length controlling means configured to lower the resulting tone value of said instrument by an additional 20.7 cents when activated by said operator together with said 102 cent insert tube and said 396 cent insert tube;

C) the second of said extra tube-length controlling means configured to lower the deeper resulting tone value of said instrument by an additional 39.8 cents when activated by said operator together with said 204 cent insert tube and said 396 cent insert tube;

D) said tube-length controlling means further configured such that said resulting tone value and said deeper resulting tone value are both generated within said prescribed tolerance.

14. In combination,

A) a stepped-pitch musical instrument;

B) a plurality of sound selection devices controlling a minimum of sixteen elements, said devices subject to operator selection, said elements sufficient to provide a defined chromatic scale of pitches containing twelve pitch stations;

C) wave propagating means responsive to activation of said elements, said wave propagating means enabling the production of sound waves of distinct frequency corresponding to said selection of said selected devices;

D) said devices further arranged such that said defined chromatic scale contains both a first and a second tone-string of said sound waves, such that said first tone-string contains the tonic pitch of said defined chromatic scale, and such that said second tone-string contains the tritone pitch of said defined chromatic scale, whereas said tonic pitch and said tritone pitch of said defined chromatic scale are together termed the tonic pair;

E) said devices further arranged such that the particular pitches of each of said first and second tone-strings are not shared in common and such that both of said first and said second tone-strings each have a precise minimum of seven similar intervals linking eight of said particular pitches in ascending succession, where similar is defined as identical within a specified tolerance, where said specified tolerance is a cent value no greater than 1.5 cents;

F) said devices further arranged such that said first and said second tone-strings together contain eight rung intervals separating eight tritone pairs, whereby the value of a particular rung interval as measured between the two paired pitches of any one of said eight tritone pairs is the same rung interval within said specified tolerance for all of said eight tritone pairs;

G) said devices further arranged such that an actual minimum of twelve of said twelve pitch stations of said defined chromatic scale are isomorphic within said specified tolerance relative to the six component pitches of three of said tritone pairs when any member of said three tritone pairs is used as the initial zero degree station for said chromatic scale, where said three tritone pairs are identified as said tonic pair, the dominant pair, and the subdominant pair;

H) said devices further arranged such that the values of a majority of the semitone intervals of said defined chromatic scale do not equal or do not approximate within a tolerance of 0.5 cents a 100.0 cent semitone interval.

15. The musical instrument in any one of claims 5 or 14,

A) said instrument belongs to the class of open stringed instruments that further utilize the fingerkeys of a keyboard as said sound selection devices, whereby said open stringed instruments sound said elements by the activation by said operator of a plurality of said fingerkeys specific to the corresponding pitches of said defined chromatic scale;

B) said fingerkeys of said keyboard arranged in a minimum of three tiers;

C) said sound selection devices further configured such that said fingerkey specific pitches increase along horizontal rows by tritone interval values of said defined chromatic scale, and increase in stepped vertical columns by semitone values of said defined chromatic scale;

D) said class of said open stringed instruments includes as a category such instuments that employ the use of virtual open strings simulated by electronic means to provide electronically generated frequencies;

E) said class of said open stringed instruments includes as a category such instuments that employ the use of a computer language such as MIDI to trigger detatched tone producing devices either in real time or at subsequent times.

16. In combination,

A) a stepped-pitch musical instrument;

B) a plurality of sound selection devices controlling a minimum of seven elements, said devices subject to operator selection, said seven elements sufficient to provide a defined natural scale of pitches;

C) wave propagating means responsive to activation of said elements, said wave propagating means enabling the production of sound waves of distinct frequency corresponding to said selection of said selected devices;

D) operator-controlled recursive switching means;

E) said sound selection devices further configured such that operator activation of said switching means alters at least one superfluous pitch expressed by said minimum of seven elements by a specific shift musical interval into a new pitch foreign to said defined natural scale;

F) said sound selection devices further configured such that subsequent actuation of said recursive switching means by said operator exchanges the expressed frequency of said foreign pitch once again in favor of the initial frequency of said superfluous pitch;

G) said sound selection devices further arranged such that the specific shift musical interval separating said foreign pitch from said superfluous pitch is either a value on or between 19.8 cents through 27.0 cents or is a value on or between 8.0 cents through 19.7 cents.

H) said sound selection devices further arranged such that all frequencies of said seven member defined natural scale are identical frequencies to certain members of a separate reference defined chromatic scale of frequencies containing twelve pitch stations, such that said seven member defined natural scale is a subset of the 12 frequencies of said defined chromatic scale;

I) said devices further arranged such that said defined natural scale is isomorphic to both the chromatic zero degree station and the chromatic sixth degree station of said defined chromatic scale of 12 frequencies;

J) said defined chromatic scale containing both a first and a second tone-string of said sound waves such that said first tone-string contains the tonic pitch of said defined chromatic scale, and such that said second tone-string contains the tritone pitch of said defined chromatic scale, whereas said tonic pitch and said tritone pitch of said defined chromatic scale are together termed the tonic pair, and such that the particular pitches of each of said first and second tone-strings are not shared in common and such that both of said first and said second tone-strings each have a precise minimum of five similar intervals linking six of said particular pitches in ascending succession, where similar is defined as identical within a specified tolerance, where said specified tolerance is a cent value no greater than 1.5 cents;

K) said first and said second tone-strings together containing six rung intervals separating six tritone pairs, whereby the value of a particular rung interval as measured between the two paired pitches of any one of said six tritone pairs is the same rung interval within said specified tolerance for all of said six tritone pairs;

L) said twelve pitch stations are isomorphic within said specified tolerance relative to either of said pitches of said tonic pair when either is used as the initial zero degree station for said chromatic scale;

M) said defined chromatic scale with values for a majority of the semitone intervals of said defined chromatic scale that do not equal or do not approximate within a tolerance of 0.5 cents a 100.0 cent semitone interval.

17. The musical instrument in any one of claims 6 or 16,

A) said instrument belongs to the class of reed instrument, whereby the pitches sounded by said reed instrument are determined by said operator forcing a stream of air along the general two dimensional plane containing one of a plurality of contained thin reeds, causing said contained thin reeds to vibrate and generate said pitches;

B) said operator-controlled recursive switching means are specific reed-damping means, such that a particular reed is incapable of vibrating in said stream of forced air when in physical contact with said specific reed-damping means;

C) whereby the activation by said operator of said specific reed-damping means replaces at minimum one of said superfluous pitches intrinsic to said reed instrument with at minimum one of said foreign pitches intrinsic to said reed instrument by altering the physical position of the contact surface of individual dampers, such that a designated damper is moved from contact with one chosen thin reed engineered to produce said foreign pitch by an operator action that next places said designated damper in immediate physical contact with another chosen thin reed engineered to produce said superfluous pitch, or vice versa.

18. The musical instrument in any one of claims 1, 14, or 16,

A) said devices further arranged such that said specified tolerance is either a value on or between 0.6 cents through 1.0 cents or is a value on or between 0.0 cents through 0.5 cents.

19. The musical instrument in any one of claims 5, 6, or 16,

A) all said sound selection devices further arranged such that said specific shift musical interval is either 11.7 cents within said specified tolerence, or is 23.4 cents within said specified tolerence.

20. The musical instrument in any one of claims 5, 14, or 16,

A) together with independent fixed sequential medium;

B) whereby said sound waves sequentially generated in one segment of time in response to the sequential activities of said operators of said instrument are sequentially captured on said fixed medium for subsequent regeneration in another segment of time.

* * * * *